US009280092B2

(12) United States Patent
Wada et al.

(10) Patent No.: US 9,280,092 B2
(45) Date of Patent: Mar. 8, 2016

(54) DEVELOPING DEVICE AND IMAGE FORMING APPARATUS INCLUDING THE SAME

(71) Applicant: KYOCERA Document Solutions Inc., Osaka-shi, Osaka (JP)

(72) Inventors: Minoru Wada, Osaka (JP); Masaru Hatano, Osaka (JP); Yoshinori Horiuchi, Osaka (JP); Akira Matayoshi, Osaka (JP); Ayaka Kondo, Osaka (JP); Motoki Moriguchi, Osaka (JP); Masahito Ishino, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/624,422

(22) Filed: Feb. 17, 2015

(65) Prior Publication Data

US 2015/0234322 A1 Aug. 20, 2015

(30) Foreign Application Priority Data

Feb. 19, 2014 (JP) ..... 2014-029630
Feb. 19, 2014 (JP) ..... 2014-029631
Feb. 19, 2014 (JP) ..... 2014-029632
Feb. 19, 2014 (JP) ..... 2014-029633
Feb. 19, 2014 (JP) ..... 2014-029634

(51) Int. Cl.
*G03G 15/08* (2006.01)

(52) U.S. Cl.
CPC ..... *G03G 15/0889* (2013.01)

(58) Field of Classification Search
None
See application file for complete search history.

(56) References Cited

U.S. PATENT DOCUMENTS 5,461,465 A * 10/1995 Sunaga et al. ..... 399/274
7,418,225 B2 * 8/2008 Morioka et al. ..... 399/274
2002/0090562 A1 * 7/2002 Sasaki et al. ..... 430/106.1
2003/0175051 A1 * 9/2003 Sato et al. ..... 399/260
2012/0008988 A1 * 1/2012 Kunihiro ..... 399/254
2012/0230737 A1 * 9/2012 Nakajima et al. ..... 399/267

FOREIGN PATENT DOCUMENTS

JP 2002258605 A 9/2002
JP 2005292301 A 10/2005

* cited by examiner

*Primary Examiner* — Clayton E LaBalle
*Assistant Examiner* — Jas Sanghera
(74) *Attorney, Agent, or Firm* — Alleman Hall McCoy Russell & Tuttle LLP

(57) ABSTRACT

A developing device includes a storing portion, a stirring member, a developing roller, a shield plate, and a guide portion. The storing portion stores developer. The stirring member is rotatably provided in the storing portion and stirs the developer in the storing portion by being rotationally driven in a predetermined first rotation direction. The developing roller is rotatably provided above the stirring member, has a magnet that attracts the developer in the storing portion by a magnetic force, and is rotationally driven in a predetermined second rotation direction. The shield plate is made of a non-magnetic material and provided at a facing position where the developing roller and the stirring member face each other. The guide portion is provided more on an upstream side in the first rotation direction than the facing position, and guides the developer from the storing portion to the developing roller side.

16 Claims, 15 Drawing Sheets

DEVELOPING DEVICE AND IMAGE FORMING APPARATUS INCLUDING THE SAME

INCORPORATION BY REFERENCE

This application is based upon and claims the benefit of priority from the corresponding Japanese Patent Application No. 2014-029630 filed on Feb.19, 2014, and No. 2014-029631 filed on Feb. 19, 2014, and No. 2014-029632 filed on Feb. 19, 2014, and No. 2014-029633 filed on Feb. 19, 2014, and No. 2014-029634 filed on Feb. 19, 2014, the entire contents of which are incorporated herein by reference.

BACKGROUND

The present disclosure relates to a developing device for developing an electrostatic latent image on an image-carrier, and to an image forming apparatus including the developing device.

An image forming apparatus, such as a copier or a printer, that forms an image on a paper sheet based on the electrophotography is provided with a developing device. The developing device uses toner to develop an electrostatic latent image formed on an image-carrier such as a photoconductor drum. The developing device includes a developing roller that is positioned a certain gap apart from the image carrier. As the developing method, there is known a method that magnetically draws up developer including toner from the developer storing chamber onto the surface of the developing roller, and causes the toner to fly from the developing roller to be adhered to an electrostatic latent image on the image carrier by an electric field generated by a developing bias applied to the developing roller.

The developing device of this type includes a stirring member for conveying the developer to a position facing the developing roller while stirring the developer stored in the developer storing chamber. As the stirring member, there are known, for example: a screw rotation member with a blade member of a helical shape attached to a rotation shaft; and a paddle rotation member with a blade member of a paddle shape attached to a rotation shaft. When adopting either of these types of stirring members, a difference in thickness is made between developer on blades of the blade member facing the developing roller and developer on regions except for the blades. Due to this difference, a difference may be made in amount of developer drawn up to the developing roller. For example, when the blades of the blade member face the developing roller, a more amount of developer is drawn up than when the regions except for the blades face the developing roller. Such a difference in draw-up amount of the developer may cause a density variation with a striped pattern corresponding to the pitch of the blade member to appear on the image. As conventional apparatuses for reducing the density variation, there are known, for example: an apparatus that presses the developer against the surface of the developing roller by using a pressing member provided more on the downstream side in the rotation direction of the developing roller than the developer draw-up position; and an apparatus that improves the draw-up characteristic of drawing up the developer onto the developing roller by intervening an auxiliary member made of a magnetic material.

SUMMARY

A developing device according to an aspect of the present disclosure includes a storing portion, a stirring member, a developing roller, a shield plate, and a guide portion. The storing portion stores developer. The stirring member is rotatably provided in the storing portion and configured to stir the developer in the storing portion by being rotationally driven in a predetermined first rotation direction. The developing roller is rotatably provided above the stirring member, has a magnet that attracts the developer in the storing portion by a magnetic force, and is configured to be rotationally driven in a predetermined second rotation direction. The shield plate is made of a nonmagnetic material and provided at a facing position where the developing roller and the stirring member face each other. The guide portion is provided more on an upstream side in the first rotation direction than the facing position, and configured to guide the developer from the storing portion to the developing roller side.

A developing device according to another aspect of the present disclosure includes a storing portion, a stirring member, a developing roller, a shield plate, and a guide portion. The storing portion stores developer. The stirring member is rotatably provided in the storing portion and configured to stir the developer in the storing portion by being rotationally driven in a predetermined first rotation direction. The developing roller is rotatably provided above the stirring member, has a magnet that attracts the developer in the storing portion by a magnetic force, and is configured to be rotationally driven in a predetermined second rotation direction. The shield plate is made of a nonmagnetic material and provided at a facing position where the developing roller and the stirring member face each other. The guide portion is provided more on a downstream side in the first rotation direction than the facing position, and configured to guide the developer peeled from the developing roller to the stirring member side in the storing portion.

A developing device according to a still another aspect of the present disclosure includes a storing portion, a stirring member, a developing roller, a cylindrical member, a first passage, and a second passage. The storing portion stores developer. The stirring member is rotatably provided in the storing portion and configured to stir the developer in the storing portion by being rotationally driven in a predetermined first rotation direction. The developing roller is rotatably provided above the stirring member, has a magnet that attracts the developer in the storing portion by a magnetic force, and is configured to be rotationally driven in a predetermined second rotation direction. The cylindrical member is made of a nonmagnetic material and surrounding an outer circumferential surface of the stirring member without contacting therewith. The first passage is formed in an outer circumferential wall of the cylindrical member more on an upstream side in the first rotation direction than a facing position where the developing roller and the stirring member face each other. The second passage is formed in the outer circumferential wall of the cylindrical member more on a downstream side in the first rotation direction than the facing position.

A developing device according to a further aspect of the present disclosure includes a storing portion, a stirring member, a developing roller, a pair of support members, and a shield plate. The storing portion stores developer. The stirring member is rotatably provided in the storing portion and configured to stir the developer in the storing portion by being rotationally driven in a predetermined first rotation direction. The developing roller is rotatably provided above the stirring member, has a magnet that attracts the developer in the storing portion by a magnetic force, and is configured to be rotationally driven in a predetermined second rotation direction. The support members respectively include arc surfaces that face circumferential surfaces of the developing roller at opposite ends of the developing roller in an axis direction of the developing roller, wherein there is a predetermined interval between the arc surfaces and the circumferential surfaces. The shield plate is made of a nonmagnetic material and provided at a facing position where the developing roller and the stirring member face each other, wherein opposite ends of the shield plate are supported by the pair of support members.

An image forming apparatus according to a still further aspect of the present disclosure includes the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the drawings. It should be noted that the following description is an example of specific embodiments of the present disclosure and the embodiments of the present disclosure can be modified as appropriate in a range where the gist of the present disclosure is not altered.

[First Embodiment]

Figure 1:
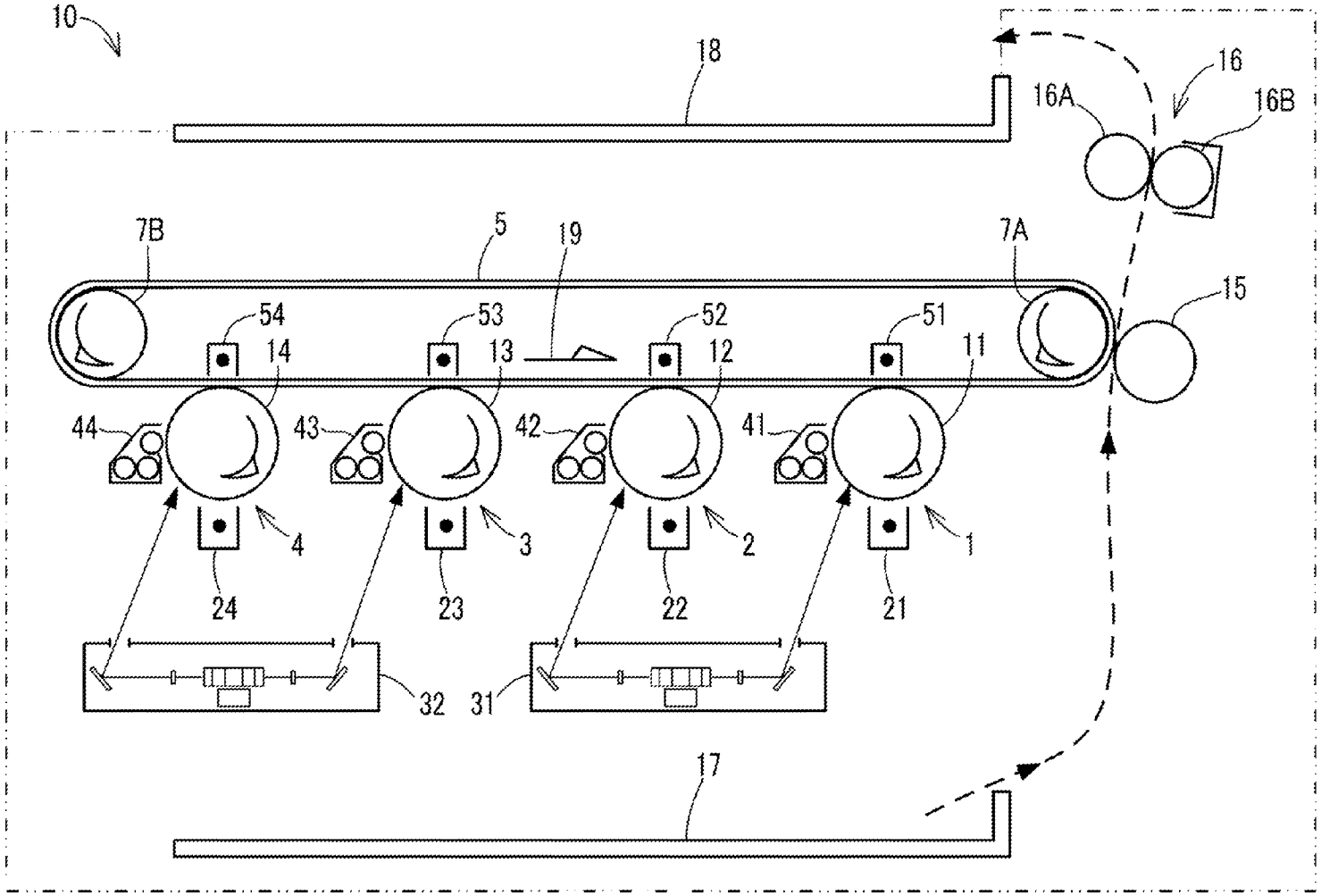
FIG. 1 is a schematic diagram showing the configuration of an image forming apparatus in the embodiments of the present disclosure.

FIG. 1 is a schematic diagram showing an outlined configuration of an image forming apparatus 10 in the first embodiment of the present disclosure. As shown in FIG. 1, the image forming apparatus 10 is a so-called tandem color image forming apparatus, and includes a plurality of image forming portions 1-4, an intermediate transfer belt 5, a driving roller 7A, a driven roller 7B, a secondary transfer device 15, a fixing device 16, a control portion (not shown), a sheet feed tray 17, a sheet discharge tray 18, and exposure devices 31 and 32. It is noted that the image forming apparatus 10 in the first embodiment of the present disclosure is not limited to a tandem color image forming apparatus, but may be a printer, a copier, or a facsimile that can form a color image or a monochrome image, or a multifunction peripheral having functions of these.

The image forming portions 1-4 form images based on the electrophotography. The image forming portions 1-4 form toner images of different colors respectively on a plurality of photoconductor drums 11-14 arranged in an alignment, and transfer the toner images onto the intermediate transfer belt 5 in sequence while the intermediate transfer belt 5 is running (moving) so that the images are overlaid with each other. In an example shown in FIG. 1, in order from the downstream side in the movement direction (the direction indicated by arrow 19) of the intermediate transfer belt 5, an image forming portion 1 for black, an image forming portion 2 for yellow, an image forming portion 3 for cyan, and an image forming portion 4 for magenta are arranged in a row in the stated order.

The image forming portions 1-4 include the photoconductor drums 11-14, charging devices 21-24, developing devices 41-44 (an example of the developing device of the present disclosure), primary transfer devices 51-54 and the like, respectively. That is, the image forming apparatus 10 includes the developing devices 41-44. The photoconductor drums 11-14 respectively carry toner images on the surfaces thereof. The charging devices 21-24 charge the surfaces of the corresponding photoconductor drums 11-14 to a certain potential. The exposure devices 31 and 32 form electrostatic latent images on the charged surfaces of the photoconductor drums 11-14 by exposing the surfaces to light that is scanned thereon. The exposure device 31 exposes the surfaces of the photoconductor drums 11 and 12 to light, and the exposure device 32 exposes the surfaces of the photoconductor drums 13 and 14 to light. The developing devices 41-44 develop, with toner, the electrostatic latent images that have been formed on the photoconductor drums 11-14 by the exposure devices 31 and 32. The primary transfer devices 51-54 transfer the toner images from the rotating photoconductor drums 11-14 onto the intermediate transfer belt 5. It is noted that although not shown in FIG. 1, the image forming apparatuses 1-4 also include cleaning devices for removing remaining toner from the surfaces of the photoconductor drums 11-14.

The intermediate transfer belt 5 is, for example, a belt having a shape of an endless loop and made of rubber, urethane or the like. The intermediate transfer belt 5 is supported by the driving roller 7A and the driven roller 7B so as to be rotationally driven. The driving roller 7A is located close to the fixing device 16 (on the right side in FIG. 1), and the driven roller 7B is located away from the fixing device 16 (on the left side in FIG. 1). The surface of the driving roller 7A is made of a material such as rubber, urethane or the like that increases friction force with the intermediate transfer belt 5.

By being supported by the driving roller 7A and the driven roller 7B, the intermediate transfer belt 5 moves (runs) while keeping its surface in contact with the surfaces of the photoconductor drums 11-14. When the intermediate transfer belt 5 passes between the photoconductor drums 11-14 and the primary transfer devices 51-54, the toner images are transferred in sequence from the photoconductor drums 11-14 onto the surface of the intermediate transfer belt 5 so that the images are overlaid with each other.

The secondary transfer device 15 transfers the toner image from the intermediate transfer belt 5 to a print sheet conveyed from the paper feed tray 17. The print sheet with the transferred toner image thereon is conveyed to the fixing device 16 by a conveyance means (not shown). The fixing device 16 includes a heating roller 16A heated to a high temperature and a pressure roller 16B disposed to face the heating roller 16A. The print sheet conveyed to the fixing device 16 is conveyed while being nipped by the heating roller 16A and the pressure roller 16B. This allows the toner image to be fused and fixed to the print sheet. The print sheet is then ejected onto the ejected paper tray 18.

As described above, the image forming apparatus 10 forms a color toner image on the surface of the intermediate transfer belt 5 by causing the plurality of image forming portions 1-4 to transfer toner images of different colors onto the intermediate transfer belt 5 while the belt is running so that the toner images are overlaid with each other. The color toner image is transferred by the secondary transfer device 15 from the intermediate transfer belt 5 to a print sheet. With this operation, a color image is formed on the print sheet. It is noted that, as another embodiment, the intermediate transfer belt 5 may be used as a conveyance belt, and the toner images may be overlaid directly on a print sheet that is conveyed on the conveyance belt. Also, as a still another embodiment, an intermediate transfer member shaped like a roller may be used in place of the intermediate transfer belt 5.

Figure 2:
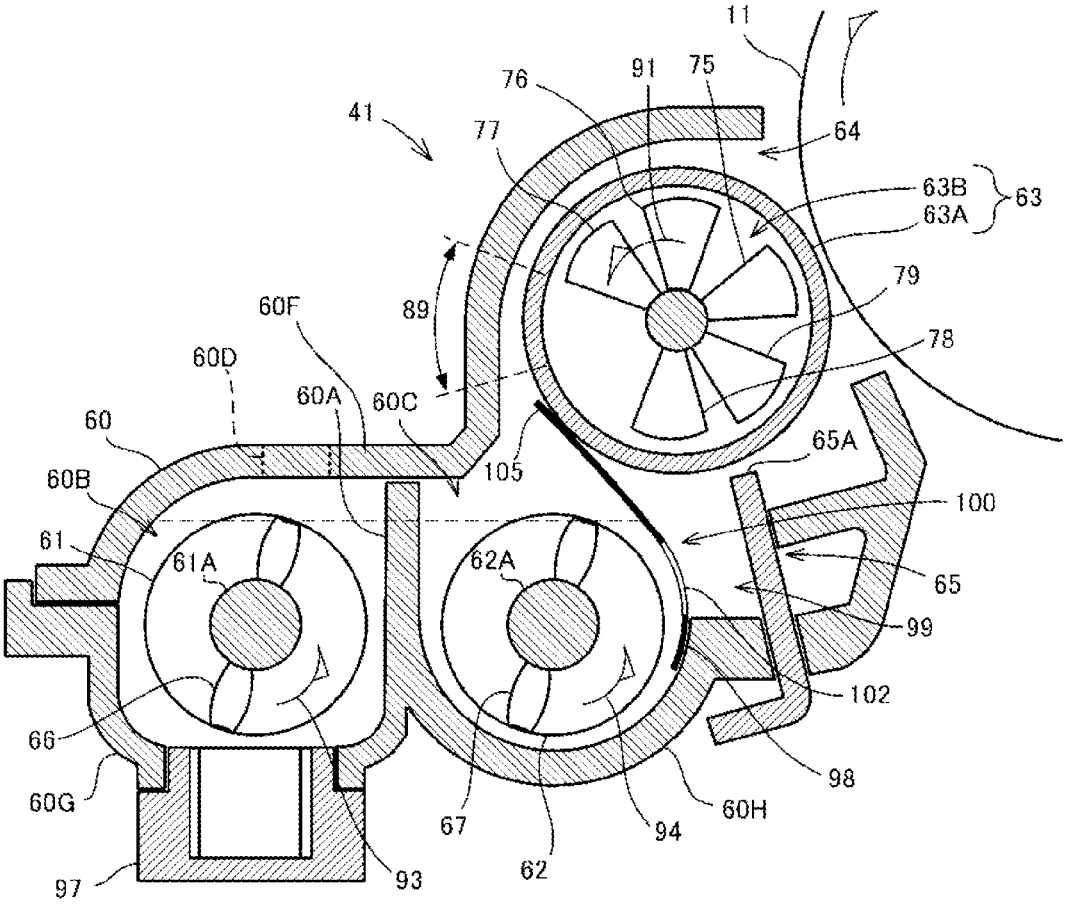
FIG. 2 is a vertical cross section showing the configuration of a developing device in the first embodiment of the present disclosure.
Figure 3:
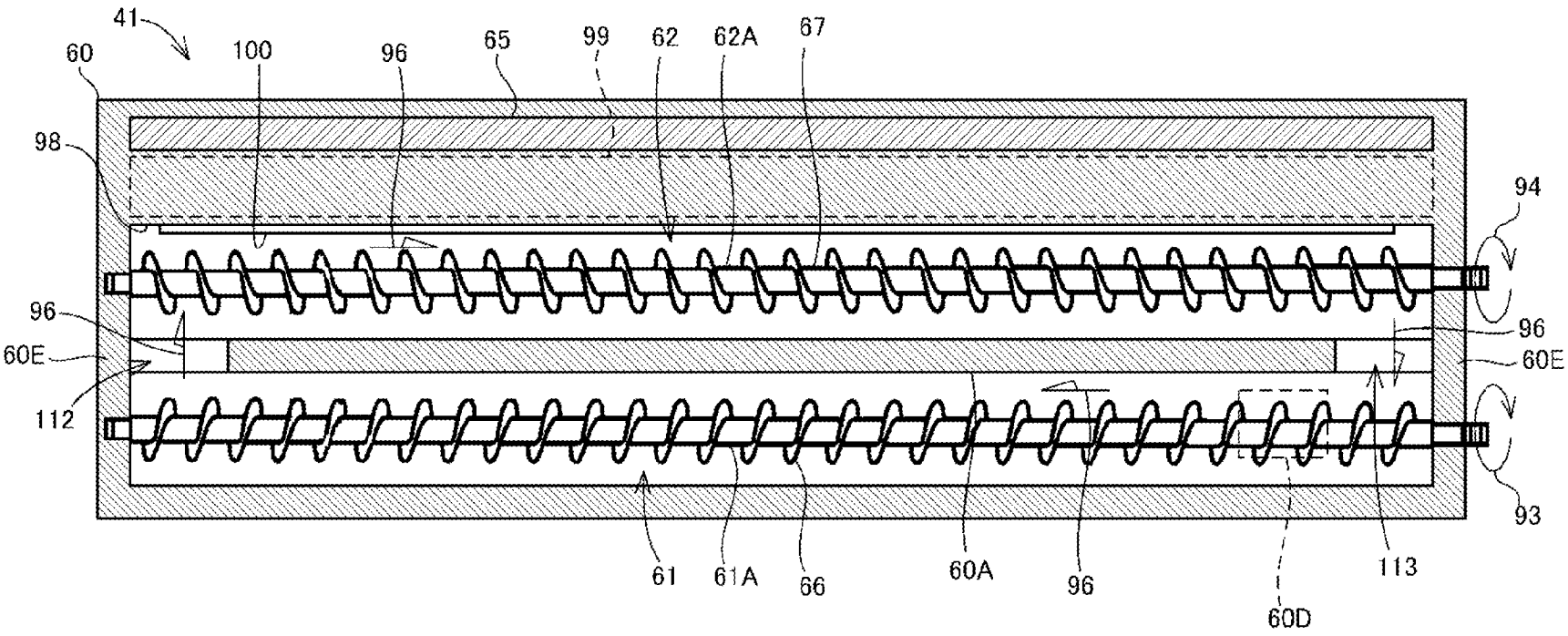
FIG. 3 is a horizontal cross section showing the configuration of the developing device in the first embodiment of the present disclosure.

FIG. 2 is a vertical cross section showing the configuration of the developing device 41 included in the image forming portion 1. FIG. 3 is a horizontal cross section showing the configuration of the developing device 41. The following explains the configuration of the developing device 41 with reference to FIGS. 2 and 3. It is noted that the other developing devices 42-44 have the same configuration as the developing device 41, thus detailed description thereof is omitted.

The developing device 41 develops the electrostatic latent image with toner by a developing system which causes toner to be adhered to the electrostatic latent image in the state where the developing device is not in contact with the photoconductor drum 11. In general, a one-component developer or a two-component developer is used in the developing, wherein the one-component developer contains, as the main component, a magnetic toner or a non-magnetic toner, and the two-component developer contains, as the main components, a non-magnetic toner and a magnetic carrier. In the present embodiment, the developing device 41 that performs the developing using a two-component developer is described as an example.

As shown in FIG. 2, the developing device 41 includes a developer case 60 (an example of the storing portion of the present disclosure), a first stirring screw 61, a second stirring screw 62 (an example of the stirring member of the present disclosure), a developing roller 63 (an example of the developing roller of the present disclosure), a shield plate 100 (an example of the shield plate of the present disclosure) and the like.

In the developer case 60, a two-component developer (hereinafter, may be merely referred to as "developer") including toner is stored. The developer case 60 servers as a housing of the developing device 41, as well as storing the developer. The developer case 60 is formed in an elongated shape extending in the longitudinal direction of the developing device 41 (in a direction vertical to the plane of FIG. 2). The developer case 60 is partitioned into a first stirring chamber 60B and a second stirring chamber 60C by a partition wall 60A. The developer is stored in both the first stirring chamber 60B and the second stirring chamber 60C. It is noted that the first stirring chamber 60B and the second stirring chamber 60C are not completely isolated from each other, but are, as shown in FIG. 3, communicated with each other via communication paths 112 and 113 that are provided at opposite ends of the developing device 41 in the longitudinal direction.

In the first stirring chamber 60B and the second stirring chamber 60C, the first stirring screw 61 and the second stirring screw 62 are rotatably provided, respectively. The first stirring screw 61 and the second stirring screw 62 are rotatably supported by side walls 60E (see FIG. 3) of the developer case 60, respectively. A bottom wall 60G of the first stirring chamber 60B, in which the first stirring screw 61 is provided, is formed in the shape of a circular arc corresponding to the outer circumference of the first stirring screw 61; and a bottom wall 60H of the second stirring chamber 60C, in which the second stirring screw 62 is provided, is formed in the shape of a circular arc corresponding to the outer circumference of the second stirring screw 62. A density detection sensor 97 for measuring toner density of the developer is attached to the bottom wall 60G. In addition, the shield plate 100 is fixed to the bottom wall 60H. It is noted that the shield plate 100 is described below.

A rotational driving force is transmitted from a motor to each of rotation shafts 61A and 62A that are rotation shafts of the first stirring screw 61 and the second stirring screw 62, respectively. This allows the first stirring screw 61 and the second stirring screw 62 to rotate in a certain direction. Specifically, the first stirring screw 61 and the second stirring screw 62 rotate counterclockwise (an example of the first rotation direction of the present disclosure) as indicated by arrows 93 and 94 in FIG. 2.

A supply port 60D is formed in the developer case 60. The supply port 60D is formed in an upper wall 60F which constitutes a flat upper wall surface of the first stirring chamber 60B. The supply port 60D is a through hole that guides toner supplied from a toner container (not shown) into the developer case 60.

As shown in FIG. 3, the first stirring screw 61 includes a blade member 66 of a helical shape that is provided around the shaft thereof', and the second stirring screw 62 includes a blade member 67 of a helical shape that is provided around the shaft thereof. With this configuration, when rotationally driven by the rotational driving force from the motor, the first stirring screw 61 and the second stirring screw 62 convey the toner that was supplied into the developer case 60 via the supply port 60D from the toner container (not shown), in the axis direction while mixing the toner with the magnetic carrier and stirring them. In addition, as the first stirring screw 61 and the second stirring screw 62 stir the developer, the toner is electrically charged. In the first embodiment, the developer is circulated through the first stirring chamber 60B and the second stirring chamber 60C via the communication paths 112 and 113 (see FIG. 3) formed in the partition wall 60A, in a direction indicated by the arrows 96 (see FIG. 3).

As shown in FIG. 2, the developing roller 63 is rotatably provided in the developer case 60. Specifically, the developing roller 63 is provided above the second stirring screw 62 that is provided in the second stirring chamber 60C. Specifically, the developing roller 63 is provided parallel to the second stirring screw 62, and is positioned closer than the second stirring screw 62 to the photoconductor drum 11. The developing roller 63 is disposed to face the second stirring screw 62 with a certain gap therebetween.

The developing roller 63 includes a developing sleeve 63A of a cylindrical shape. The developing sleeve 63A is rotatably supported in the second stirring chamber 60C. The developing sleeve 63A is composed of a raw pipe made of aluminum.

The developing roller 63 faces the photoconductor drum 11 at an opening 64 side of the developer case 60 (the right side in FIG. 2). That is, the developing roller 63 is disposed to face the outer circumferential surface of the photoconductor drum 11 with a certain gap therebetween. Upon receiving the rotational driving force from the motor (not shown), the developing roller 63 is rotated counterclockwise (an example of the second rotation direction of the present disclosure) as indicated by the arrow 91 in FIG. 2. That is, the rotation directions of the developing roller 63 and the second stirring screw 62 are the same and the developing roller 63 is rotated in the same rotation direction as the second stirring screw 62.

The developing roller 63 includes a magnet unit 63B that includes a plurality of magnetic poles. The magnet unit 63B is provided inside the developing sleeve 63A. The magnet unit 63B is fixed inside the developing sleeve 63A. In the first embodiment, the magnet unit 63B has five magnetic poles: a main pole 75; a carrying pole 76; a peeling pole 77; a draw-up pole 78; and a regulation pole 79. The magnetic poles 75-79 may be, for example, permanent magnets that generate magnetic forces.

The main pole 75 is a magnetic pole that generates a peak magnetic force at a position where it faces the photoconductor drum 11. The main pole 75 is attached to the magnet unit 63B in the state where the magnetic pole face of the main pole 75 is oriented toward the photoconductor drum 11 side.

The carrying pole 76 is a magnetic pole having a different polarity from the main pole 75. The carrying pole 76 allows the developer to be held on the developing sleeve 63A by generating a magnetic field whose field direction is the circumferential direction of the developing sleeve 63A, and allows the developer to be carried in the circumferential direction.

The peeling pole 77 is a magnetic pole that forms a peeling region 89 on an opposite side of the developing sleeve 63A to the photoconductor drum 11, wherein the magnetic flux density of the peeling region 89 is substantially zero. When the developer is conveyed to the peeling region 89, the magnetic force that adsorbs the developer is lost, and the developer is peeled off from the developing sleeve 63A in the peeling region 89. The peeled developer drops onto the second stirring screw 62 that is positioned below the peeling region 89, returns to the second stirring chamber 60C, and is conveyed again, while being stirred, by the second stirring screw 62. Subsequently, the developer is conveyed while being stirred by the first stirring screw 61 and the second stirring screw 62, and then drawn up again onto the developing sleeve 63A by the draw-up pole 78 as a developer that has appropriate toner density and has been uniformly charged.

The draw-up pole 78 is a magnetic pole that generates a peak magnetic force at a position where it faces the second stirring screw 62. Specifically, the draw-up pole 78 generates the peak magnetic force in a region between a regulation blade 65 described below and a line segment connecting the rotation shaft 62A of the second stirring screw 62 and the rotation shaft of the developing roller 63. The developer is attracted and adsorbed to the surface of the developing sleeve 63A by the magnetic force of the draw-up pole 78. This allows the developer to be held on the surface of the developing sleeve 63A. When the developing sleeve 63A is rotated in this state, the developer is conveyed to the position where it faces the photoconductor drum 11. It is noted that the draw-up pole 78 may be any member as far as it attracts and allows the developer to be held on the surface of the developing sleeve 63A. For example, the draw-up pole 78 may be such a member that generates the peak magnetic force in a direction along the line segment.

The developer case 60 is provided with the regulation blade 65 (an example of the regulation member of the present disclosure). The regulation blade 65 is made of a magnetic material and is, for example, a plate-like member made of a metal having magnetism. The regulation blade 65 is attached along the longitudinal direction of the developer case 60 (the direction vertical to the plane of FIG. 2). The regulation blade 65 is disposed more on the downstream side in the rotation direction of the developing roller 63 (see the arrow 91) than the facing position where the developing roller 63 faces the second stirring screw 62. A small gap is formed between a tip 65A of the regulation blade 65 and the roller surface of the developing roller 63. The developer adhered to the developing roller 63 is regulated by the regulation blade 65 that receives a magnetic force from the draw-up pole 78, to a thickness that corresponds to the gap. The regulation pole 79 is a magnetic pole that allows the developer to be held on the developing sleeve 63A and carried in the circumferential direction.

In the developing device 41 with the above-described configuration, the layer of the developer formed on the developing sleeve 63A is varied in thickness in correspondence with the pitch of the blade member 67 in the axis direction of the second stirring screw 62. This thickness variation may not necessarily be uniformed by the regulation blade 65, and the developer may be conveyed to the position where it faces the photoconductor drum 11 while it maintains the thickness variation. In that case, the thickness variation appears as a density variation on the image. Specifically, a density variation with a striped pattern corresponding to the pitch appears on the image. To prevent such a density variation, the developing device 41 of the first embodiment is provided with the shield plate 100.

It is noted that a conventional mechanism intended to solve the density variation is required to newly include a pressing member or an auxiliary member. This becomes a factor in increasing the number of parts of the developing device and enlarging the developing device. In addition, the pressing member gives an unnecessary stress to the developer, resulting in a short life of the toner included in the developer and reduction of the charging characteristic. Furthermore, even if the draw-up characteristic is improved by the auxiliary member and the density variation is reduced, occurrence of a difference in draw-up amount of the developer cannot be solved. As a result, the auxiliary member cannot prevent the density variation.

The following describes the configuration of the shield plate 100 with reference to FIGS. 2 and 3.

As shown in FIGS. 2 and 3, the shield plate 100 is provided at a facing position where the developing roller 63 and the second stirring screw 62 face each other. The shield plate 100 is a plate-like member made of a nonmagnetic material. Specifically, the shield plate 100 is a film-like resin plate member (for example, a PET film) that is formed from a synthetic resin that does not have magnetism and is elastic. The shield plate 100 is formed in a shape elongated in the longitudinal direction of the developer case 60 (the direction vertical to the plane of FIG. 2). The shield plate 100 is fixed to the circulararc-shaped bottom wall 60H that constitutes the outer wall of the bottom of the second stirring chamber 60C. Specifically, the shield plate 100 is fixed to an end 98 of the bottom wall 60H, the end 98 being an end on the downstream side in the rotation direction (indicated by the arrow 94) of the second stirring screw 62. More specifically, an end of the shield plate 100 in the short direction is fixed to the end 98. It is noted that various fixation methods such as adhesion, screw fastening, crimping, and welding are applicable to fix the shield plate 100.

The shield plate 100 is linearly extended from the end 98 toward the facing position where the developing roller 63 and the second stirring screw 62 face each other. An extension end 105 of the shield plate 100 in the extension direction abuts on the roller surface of the developing roller 63, namely, the surface of the developing sleeve 63A. The part of the extension end 105 that is to abut on the developing sleeve 63A is made of an elastic member that is softer than the surface of the developing sleeve 63A. Specifically, an elastic member made of urethane or the like is adhered to a surface of the extension end 105 that is to abut on the developing sleeve 63A. This prevents the surface of the developing sleeve 63A from being damaged by abutting on the extension end 105.

The shield plate 100 is provided with a passage 102 (an example of the guide portion of the present disclosure) for guiding the developer. The passage 102 is not provided at the facing position where the developing roller 63 and the second stirring screw 62 face each other, but is provided more on the upstream side in the rotation direction of the second stirring screw 62 than the facing position. Specifically, the passage 102 is provided in the shield plate 100 on the end 98 side. The passage 102 is a pass-through opening formed in the shield plate 100. The passage 102 is an opening that extends long and narrow in the longitudinal direction of the developer case 60. The developer stirred by the second stirring screw 62 passes through the passage 102 to be guided to the surface of the developing roller 63.

In the first embodiment, a retaining space 99 is formed on a route that extends from the passage 102 of the shield plate 100 to the roller surface of the developing roller 63. The retaining space 99 is a space for retaining the developer that has come out of the passage 102. The retaining space 99 is formed as a space between the second stirring screw 62 and the regulation blade 65. The retaining space 99 is formed between the second stirring screw 62 and the regulation blade 65 by positioning the regulation blade 65 away from the second stirring screw 62 toward the downstream side in the rotation direction of the developing roller 63. With this configuration, the developer that has passed through the passage 102 slows its movement toward the surface of the developing roller 63 and is retained in the retaining space 99. The developer, while being retained in the retaining space 99, moves slowly toward the developing roller 63. During this slow movement, the difference in draw-up amount of the developer that corresponds to the pitch of the blade member 67 is uniformed, wherein the difference in draw-up amount of the developer may be the cause of the thickness variation of the developer.

As described above, in the developing device 41 of the first embodiment, the shield plate 100 is provided at the facing position where the developing roller 63 and the second stirring screw 62 face each other. That is, the shield plate 100 is present on the route with the shortest distance from the second stirring screw 62 to the developing roller 63, namely, the route passing through the line segment connecting the rotation shaft 62A and the rotation shaft of the developing roller 63. As a result, if the developer is drawn up by the draw-up pole 78, it does not happen that the developer is supplied to the developing roller 63 by passing through the route. On the other hand, since the passage 102 is formed in the shield plate 100, the developer is guided from the second stirring screw 62 to the developing roller 63 by passing through the passage 102 while being attracted by the magnetic force of the draw-up pole 78. That is, the developer does not pass through the facing position where the developing roller 63 and the second stirring screw 62 face each other, but passes through the passage 102 to bypass the facing position and is guided to the developing roller 63. With this configuration, the route for the developer to reach the developing roller 63 is lengthened, and the cause of the thickness variation of the developer is solved while the developer moves in the lengthened route. As a result, it is possible to uniform the amount of developer drawn up to the developing roller 63, without giving the stress to the developer. In addition, the configuration does not prohibit the developer peeled in the peeling region 89 from dropping to the second stirring screw 62.

Furthermore, the retaining space 99 formed in the developer case 60 makes it possible to slow down the movement of the developer that has entered the retaining space 99 via the passage 102. With this configuration, the amount of developer becomes uniform in the longitudinal direction of the retaining space 99, and the amount of developer drawn up to the developing roller 63 becomes uniform. In addition, since the developer retained in the retaining space 99 contacts the roller surface of the developing roller 63, the developer is easily drawn up to the roller surface of the developing roller 63.

Furthermore, since the extension end 105 of the shield plate 100 abuts on the roller surface of the developing roller 63, the developer that remains on the roller surface of the developing roller 63 without being peeled after the developing can be scraped off by the extension end 105. In addition, even when the developer peeled in the peeling region 89 flies toward the retaining space 99 side, the developer can be dropped to the second stirring screw 62 side by the shield plate 100 in a reliable manner. It is noted that the peeled developer is stirred again by the second stirring screw 62.

In the first embodiment, the second stirring screw 62 having the blade member 67 of a helical shape is described as an example. However, the present disclosure is applicable to, for example, a stirring member that extends in the axis direction of the rotation shaft 62A and includes paddle-shaped blades extending from the rotation shaft 62A in a direction perpendicular to the axis direction. This also applies to the second through fifth embodiments described below.

In addition, in the first embodiment, a configuration where the extension end 105 of the shield plate 100 abuts on the roller surface of the developing roller 63 is described as an example. However, the present disclosure is not limited to this. When the extension end 105 is proximate to the roller surface of the developing roller 63, the shield plate 100 can drop the developer peeled in the peeling region 89 to the second stirring screw 62 side in a reliable manner.

[Modification of first embodiment]

Figure 4:
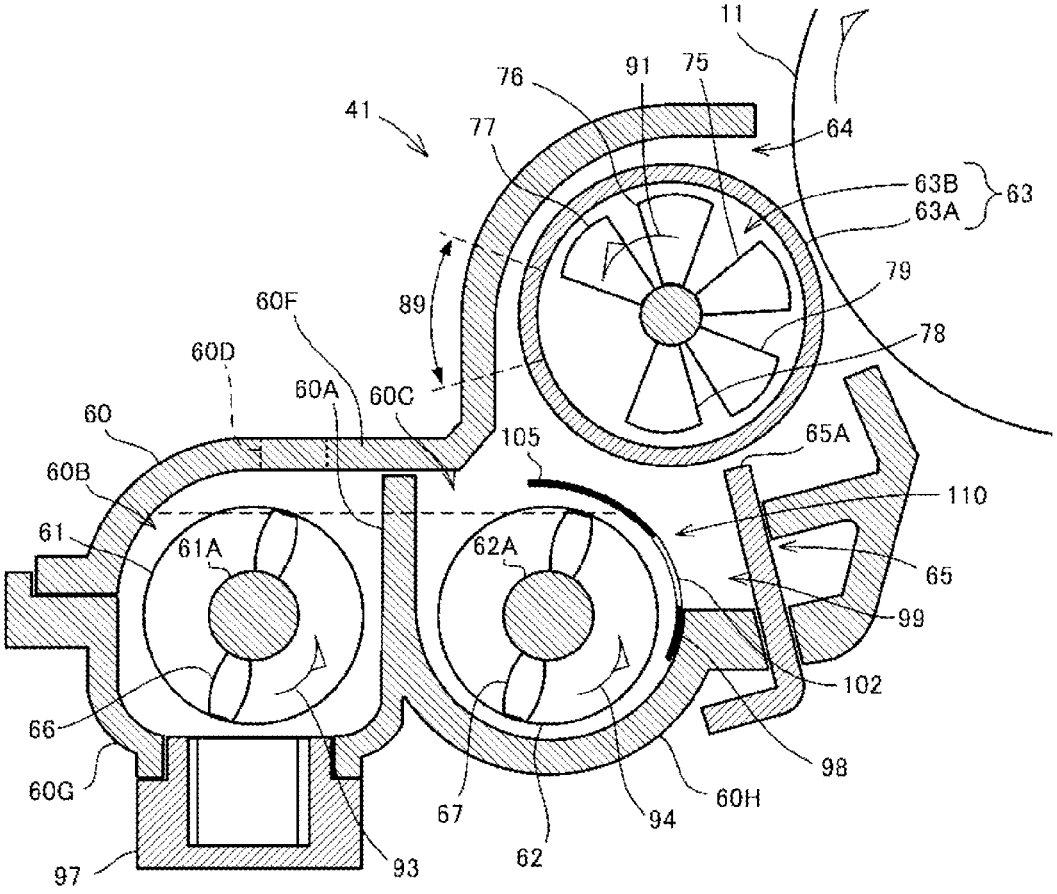
FIG. 4 is a diagram showing a modification of a shield plate in the first embodiment of the present disclosure.

The following describes, with reference to FIG. 4, a shield plate 110 that is a modification of the shield plate 100 of the first embodiment. Here, FIG. 4 is a cross section showing the configuration of the developing device 41 including the shield plate 110. It is noted that the same component elements as those described in the first embodiment are assigned the same reference numbers, and description thereof is omitted.

The shield plate 110 shown in FIG. 4 is made of the same material as the shield plate 100 of the above-described first embodiment. That is, the shield plate 110 is a film-like resin plate member that is formed from a synthetic resin that does not have magnetism and is elastic. The shield plate 110 is different from the shield plate 100 in shape, and otherwise is common to the shield plate 100. An end of the shield plate 110 in the short direction is fixed to the end 98 of the bottom wall 60H. In addition, the shield plate 110 extends to curve from the end 98 toward the facing position where the developing roller 63 and the second stirring screw 62 face each other. Specifically, the shield plate 110 extends along the outer circumferential surface of the second stirring screw 62 toward the facing position where the developing roller 63 and the second stirring screw 62 face each other. The shield plate 110 may be formed in the curved shape by being bent by a support member that is not shown. Alternatively, the shield plate 110 may be formed in the curved shape originally by the molding. The shield plate 110 is provided in the second stirring chamber 60C in such a state where the distance from the outer circumferential surface of the second stirring screw 62 is maintained to be constant. The extension end 105 of the shield plate 110 does not abut on anything, and is positioned such that it does not close the passage extending from the peeling region 89 to the second stirring chamber 60C. Specifically, the extension end 105 is positioned proximate to a vertical line that passes through the rotation shaft 62A. In the shield plate 110, the passage 102 is provided on the end 98 side. It is noted that the extension end 105 of the shield plate 110 is disposed in the vicinity of the second stirring screw 62. Furthermore, the extension end 105 of the shield plate 110 or a surface of the shield plate 110 on the extension end 105 side may be in contact with the second stirring screw 62.

With the shield plate 110 configured as such, it is possible to uniform the amount of developer drawn up to the developing roller 63, without giving the stress to the developer. In addition, the configuration does not prohibit the developer peeled in the peeling region 89 from dropping to the second stirring screw 62.

[Second Embodiment]

Next, the second embodiment of the present disclosure is described with reference to FIGS. 5 through 7. The second embodiment differs from the first embodiment in that a shield plate 120 is applied in place of the shield plate 100. As a result, in the following description, the same component elements as those described in the first embodiment are assigned the same reference numbers, and description thereof and description of modification are omitted.

The developing device 41 includes the shield plate 120 (an example of the shield plate of the present disclosure). The shield plate 120 is fixed to the regulation blade 65. The shield plate 120 is provided to prevent the density variation in the image that is caused by the thickness variation.

Figure 5:
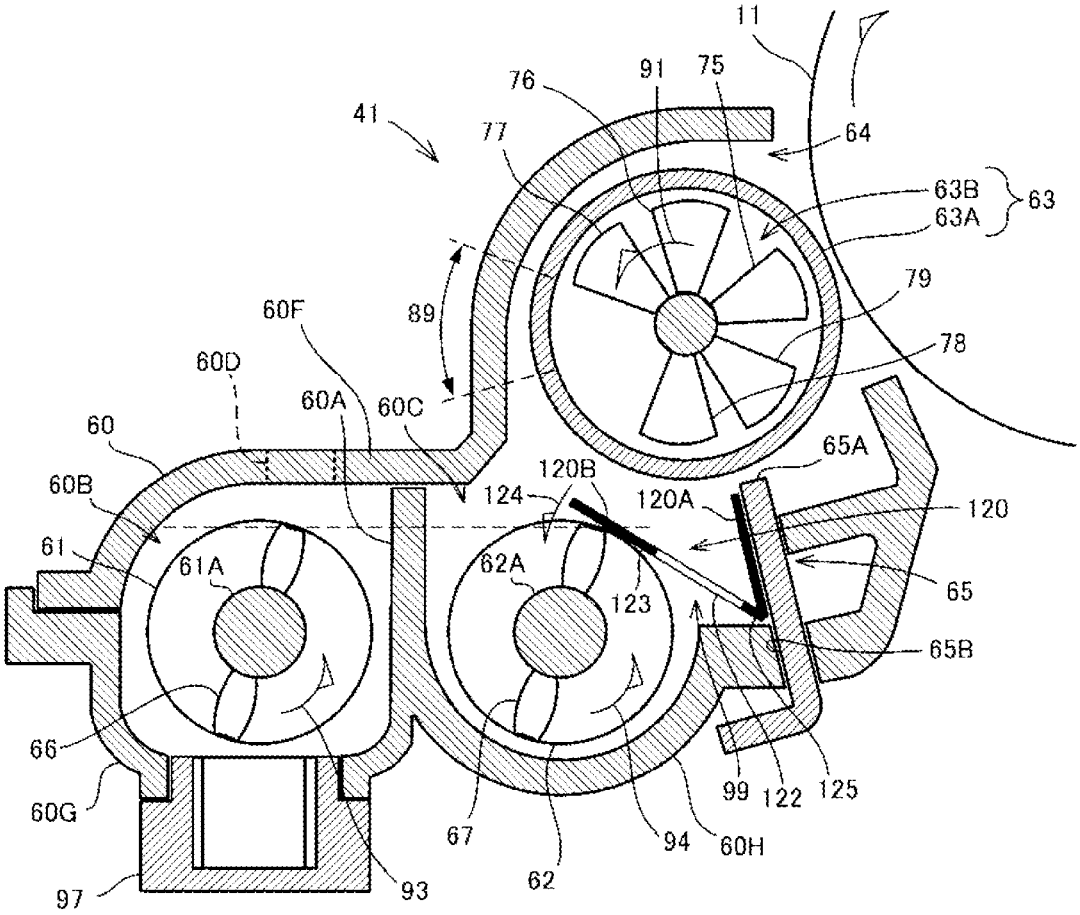
FIG. 5 is a vertical cross section showing the configuration of a developing device in the second embodiment of the present disclosure.
Figure 6:
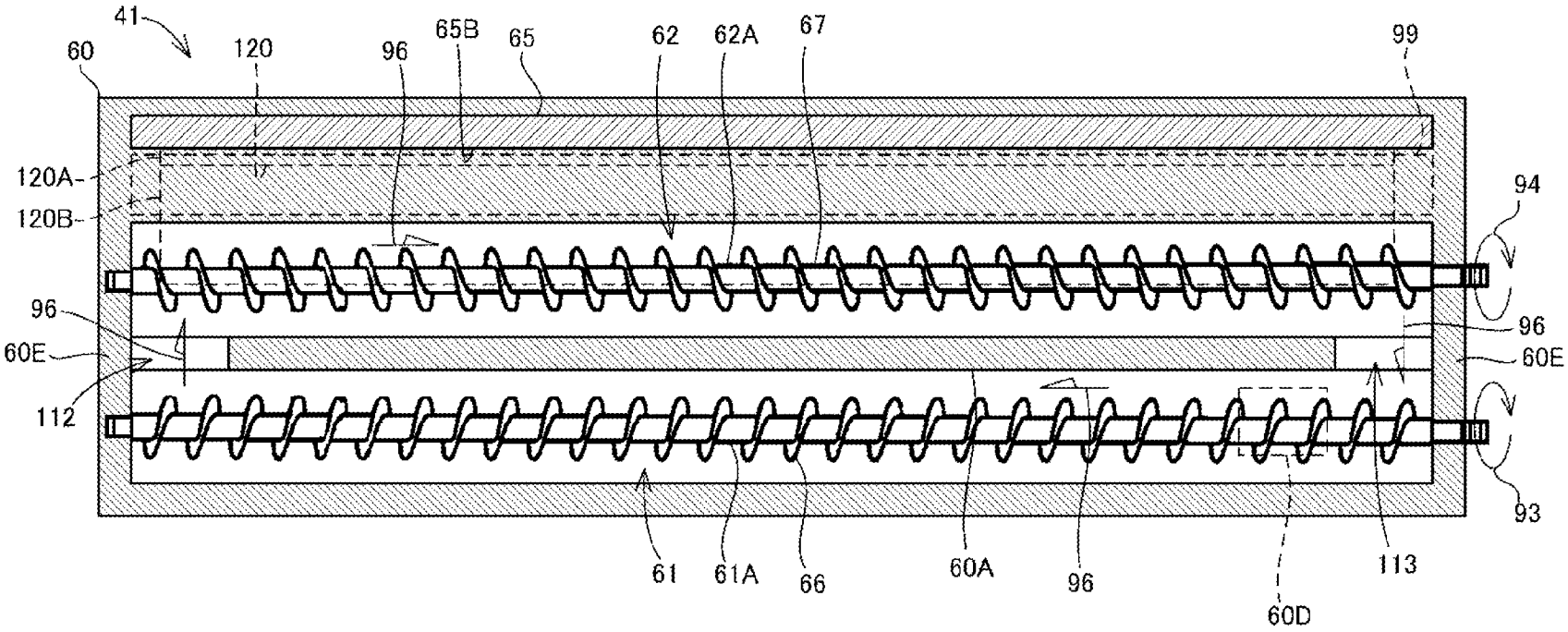
FIG. 6 is a horizontal cross section showing the configuration of the developing device in the second embodiment of the present disclosure.

The following describes the configuration of the shield plate 120 with reference to FIGS. 5 and 6.

As shown in FIGS. 5 and 6, the shield plate 120 is provided at the facing position where the developing roller 63 and the second stirring screw 62 face each other. The shield plate 120 is a plate-like member made of a nonmagnetic material. Specifically, the shield plate 120 is a film-like resin plate member (for example, a PET film) that is formed from a synthetic resin that does not have magnetism and is elastic. The shield plate 120 is formed in a shape elongated in the longitudinal direction of the developer case 60 (the direction vertical to the plane of FIG. 5). The shield plate 120 is fixed to the regulation blade 65 that is provided on the downstream side in the rotation direction (indicated by the arrow 91) of the developing roller 63 and serves as the fixing portion, and is linearly extended from the regulation blade 65 toward the facing position where the developing roller 63 and the second stirring screw 62 face each other. Specifically, an end of the shield plate 120 in the short direction is fixed to the regulation blade 65. The shield plate 120 extends from the regulation blade 65 toward the facing position, and a lower surface 123 of the shield plate 120 abuts on the outer circumferential surface of the second stirring screw 62.

The shield plate 120 is formed by folding the resin plate member such as a PET film in the shape of V along a fold line 125 that extends in the longitudinal direction. The fold line 125 is provided on the shield plate 120 near a fixing end 120A that is an end of the shield plate 120 fixed to the regulation blade 65. The fixing end 120A is fixed to a side surface 65B of the regulation blade 65 such that an edge thereof is close to the tip 65A of the regulation blade 65. Here, the side surface 65B is, among two opposite side surfaces of the regulation blade 65, a side surface near the second stirring screw 62. It is noted that various fixation methods such as adhesion, screw fastening, crimping, and welding are applicable to fix the fixing end 120A.

The shield plate 120 includes an extended portion 120B on the opposite side to the fixing end 120A. The extended portion 120B extends from the fold line 125 upward above the second stirring screw 62 in the state where the fixing end 120A is fixed to the regulation blade 65. The lower surface 123 of the shield plate 120 abuts on the outer circumferential surface of the second stirring screw 62. The extension end of the extended portion 120B does not contact anything and reaches to a position where it does not close the passage extending from the peeling region 89 to the second stirring chamber 60C. Specifically, the extension end of the extended portion 120B is positioned proximate to a vertical line that passes through the rotation shaft 62A. In the second embodiment, since the shield plate 120 is bent at the fold line 125, the extended portion 120B intends to be dislocated in a direction 124 of moving away from the fixing end 120A with the fold line 125 as a base point. The force for dislocating the extended portion 120B is based on the restoring force for returning the shield plate 120 to the original shape before the deformation. The extended portion 120B is positioned above the second stirring screw 62 in the state where the extended portion 120B is pulled toward the fixing end 120A, resisting the force for dislocating. With this configuration, the extended portion 120B is elastically biased toward the outer circumferential surface of the second stirring screw 62 by the restoring force of the shield plate 120. That is, the extended portion 120B is pressed against the outer circumferential surface of the second stirring screw 62 by the restoring force. It is noted that the extended portion 120B abuts on the outer circumferential surface of the second stirring screw 62, but it does not abut on the roller surface of the developing roller 63.

The shield plate 120 is provided with a passage 122 (an example of the guide portion of the present disclosure) for guiding the developer. The passage 122 is formed in the extended portion 120B. The passage 122 is not provided at the facing position where the developing roller 63 and the second stirring screw 62 face each other, but is provided more on the upstream side in the rotation direction of the second stirring screw 62 than the facing position. Specifically, the passage 122 is provided in the extended portion 120B of the shield plate 120 on the regulation blade 65 side. The passage 122 is a pass-through opening formed in the extended portion 120B. The passage 122 is an opening that extends long and narrow in the longitudinal direction of the developer case 60. The developer stirred by the second stirring screw 62 passes through the passage 122 to be guided to the surface of the developing roller 63.

In the second embodiment, the retaining space 99 is formed on a route that extends from the second stirring screw 62 to the roller surface of the developing roller 63 via the passage 122. The retaining space 99 is a space for retaining the developer that has been conveyed from the second stirring screw 62. The retaining space 99 is a space formed between the second stirring screw 62 and the regulation blade 65. The retaining space 99 is formed between the second stirring screw 62 and the regulation blade 65 by positioning the regulation blade 65 away from the second stirring screw 62 toward the downstream side in the rotation direction of the developing roller 63. As shown in FIG. 5, the passage 122 is positioned approximately at the center of the retaining space 99. With this configuration, the developer that has been conveyed from the second stirring screw 62 into the retaining space 99 slows its movement toward the surface of the developing roller 63 before and after it passes through the passage 122 and is retained in the retaining space 99. The developer, while being retained in the retaining space 99, moves slowly toward the developing roller 63. During this slow movement, the difference in draw-up amount of the developer that corresponds to the pitch of the blade member 67 is uniformed, wherein the difference in draw-up amount of the developer may be the cause of the thickness variation of the developer.

As described above, in the developing device 41 of the second embodiment, the shield plate 120 is provided at the facing position where the developing roller 63 and the second stirring screw 62 face each other. That is, the shield plate 120 is present on the route with the shortest distance from the second stirring screw 62 to the developing roller 63, namely, the route passing through the line segment connecting the rotation shaft 62A and the rotation shaft of the developing roller 63. As a result, if the developer is drawn up by the draw-up pole 78, it does not happen that the developer is supplied to the developing roller 63 by passing through the route. On the other hand, since the passage 122 is formed in the shield plate 120, the developer is guided from the second stirring screw 62 to the developing roller 63 by passing through the passage 122 while being attracted by the magnetic force of the draw-up pole 78. That is, the developer does not pass through the facing position where the developing roller 63 and the second stirring screw 62 face each other, but passes through the passage 122 by bypassing the facing position and is guided to the developing roller 63. With this configuration, the route for the developer to reach the developing roller 63 is lengthened, and the cause of the thickness variation of the developer is solved while the developer moves in the lengthened route. As a result, it is possible to uniform the amount of developer drawn up to the developing roller 63, without giving the stress to the developer. In addition, the configuration does not prohibit the developer peeled in the peeling region 89 from dropping to the second stirring screw 62.

In addition, with the configuration where the fixing end 120A of the shield plate 120 is fixed to the regulation blade 65, the attachment of the shield plate 120 in the developer case 60 becomes easy.

Furthermore, the extended portion 120B of the shield plate 120 abuts on the outer circumferential surface of the second stirring screw 62 at an upper part thereof, and the extended portion 120B is elastically pressed against the outer circumferential surface by the restoring force of the shield plate 120. This stabilizes the position of the extended portion 120B, restricting it from swaying. With this configuration, even when a repulsive force is received from the rotating second stirring screw 62 in a direction of moving the shield plate 120 away from the second stirring screw 62, the extended portion 120B does not contact the developing roller 63. This prevents the developer drawn up by the developing roller 63 from dropping due to a contact, thereby stabilizing the amount of developer on the roller surface of the developing roller 63.

Furthermore, since the retaining space 99 is formed in the developer case 60, it is possible to slow the movement of the developer that has entered the retaining space 99 via the passage 122. With this configuration, the amount of developer becomes uniform in the longitudinal direction of the retaining space 99, and the amount of developer drawn up to the developing roller 63 becomes uniform. In addition, since the developer retained in the retaining space 99 contacts the roller surface of the developing roller 63, the developer is easily drawn up to the roller surface of the developing roller 63.

It is noted that, although in the second embodiment, a configuration where the fixing end 120A of the shield plate 120 is fixed to the regulation blade 65 is described as an example, the present disclosure is not limited to this configuration. The fixing end 120A may be fixed to any position as far as the extended portion 120B can abut on the upper part of the second stirring screw 62. For example, the fixing end 120A may be fixed to the lower surface of the retaining space 99.

[Modification of Second Embodiment]

Figure 7:
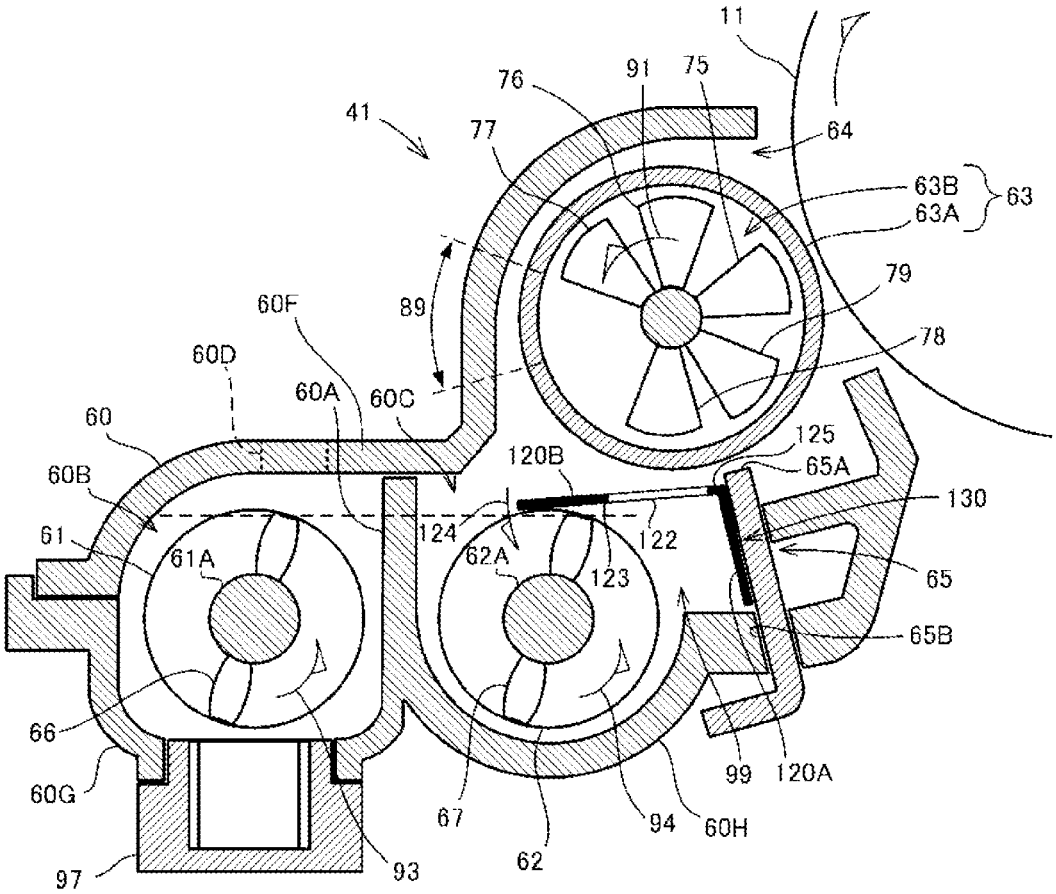
FIG. 7 is a diagram showing a modification of a shield plate in the second embodiment of the present disclosure.

The following describes, with reference to FIG. 7, a shield plate 130 that is a modification of the shield plate 120 of the second embodiment. Here, FIG. 7 is a cross section showing the configuration of the developing device 41 including the shield plate 130. It is noted that the same component elements as those described in the embodiments so far are assigned the same reference numbers, and description thereof is omitted.

The shield plate 130 shown in FIG. 7 is made of the same material as the shield plate 120 of the above-described second embodiment. That is, the shield plate 130 is composed of a film-like resin plate member (for example, a PET film) that is formed from a synthetic resin that does not have magnetism and is elastic. The shield plate 130 is different from the shield plate 120 in shape, and otherwise is common to the shield plate 120. The shield plate 130 is formed by folding the resin plate member, such as a PET film, into the shape of a reversed L along a fold line 125 that extends in the longitudinal direction. The fixing end 120A is fixed to the side surface 65B of the regulation blade 65 in such a manner that the fold line 125 is close to the tip 65A of the regulation blade 65 and an edge of the fixing end 120A is close to the bottom of the retaining space 99 opposite to the tip 65A of the regulation blade 65. The extended portion 120B extends from the tip 65A near the fold line 125 upward above the second stirring screw 62 in the state where the fixing end 120A is fixed to the regulation blade 65. The lower surface 123 of the extended portion 120B abuts on the outer circumferential surface of the second stirring screw 62. In the present embodiment, when the shield plate 130 is bent with a strong force at the fold line 125 and is deformed by plastic deformation into, for example, the shape of V, the extended portion 120B intends to be dislocated in the direction 124 of approaching the fixing end 120A with the fold line 125 as a base point. The force for dislocating the extended portion 120B is based on the restoring force for returning the shield plate 120 to the shape after the deformation. The extended portion 120B is positioned above the second stirring screw 62 in the state where the extended portion 120B is pulled in a direction of moving away from the fixing end 120A, resisting the force for dislocating. With this configuration, the extended portion 120B is elastically biased toward the outer circumferential surface of the second stirring screw 62 by the restoring force of the shield plate 130. That is, the extended portion 120B is pressed against the outer circumferential surface of the second stirring screw 62 by the restoring force.

With the shield plate 130 configured as such, it is possible to uniform the amount of developer drawn up to the developing roller 63, without giving the stress to the developer. In addition, the configuration does not prohibit the developer peeled in the peeling region 89 from dropping to the second stirring screw 62. Furthermore, it is possible to stabilize the position of the extended portion 120B of the shield plate 130.

[Third Embodiment]

Next, the third embodiment of the present disclosure is described with reference to FIGS. 8 through 10. The third embodiment differs from the above-described first embodiment in that a shield plate 140 is applied in place of the shield plate 100. As a result, in the following description, the same component elements as those described in the first embodiment are assigned the same reference numbers, and description thereof and description of modification are omitted.

The developing device 41 includes the shield plate 140 (an example of the shield plate of the present disclosure). The shield plate 140 is fixed to the upper wall 60F of the developer case 60. The shield plate 140 is provided to prevent the density variation in the image that is caused by the thickness variation.

Figure 8:
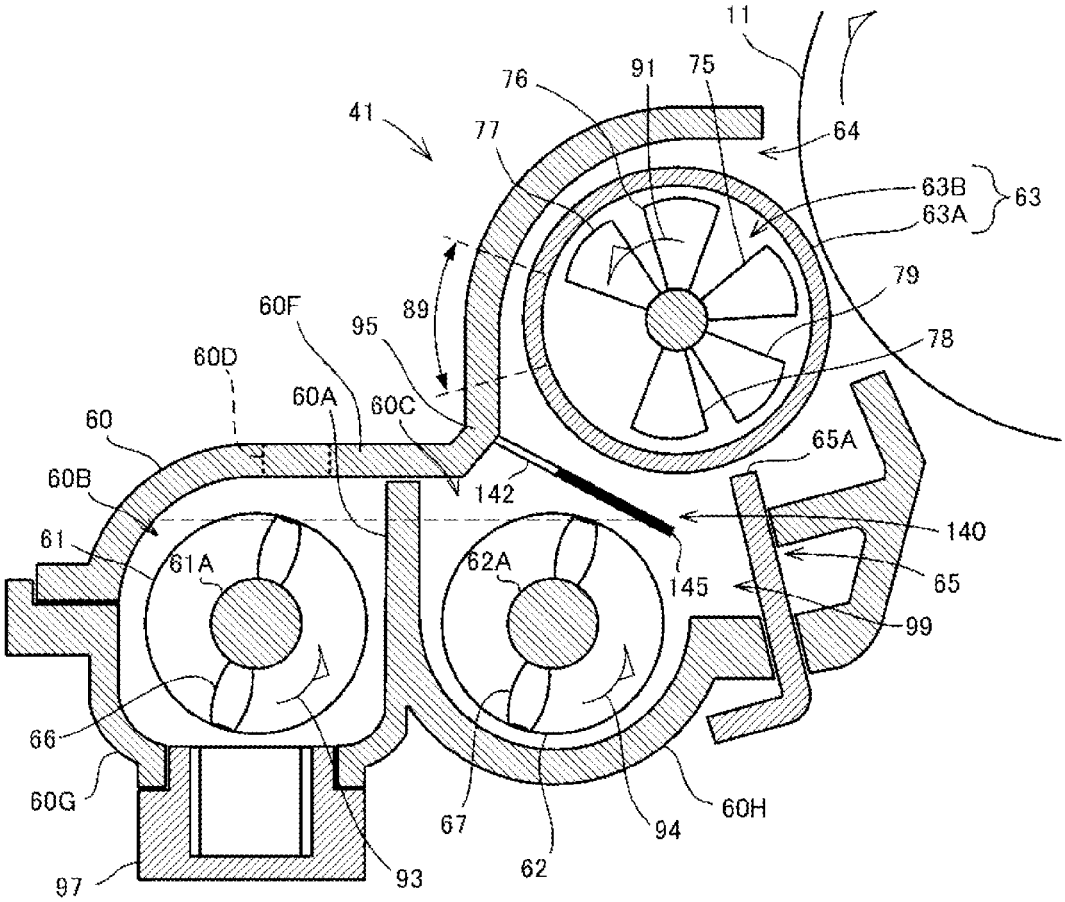
FIG. 8 is a vertical cross section showing the configuration of a developing device in the third embodiment of the present disclosure.
Figure 9:
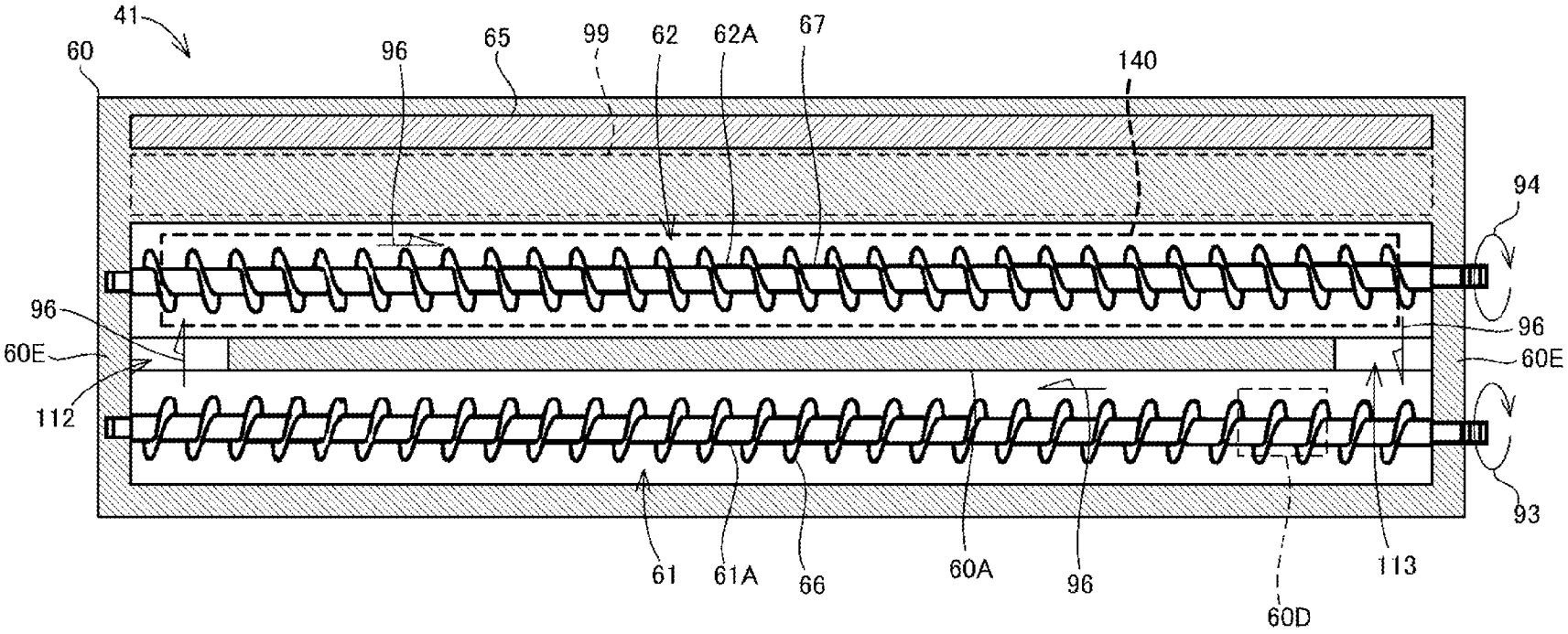
FIG. 9 is a horizontal cross section showing the configuration of the developing device in the third embodiment of the present disclosure.

The following describes the configuration of the shield plate 140 with reference to FIGS. 8 and 9.

As shown in FIGS. 8 and 9, the shield plate 140 is provided at the facing position where the developing roller 63 and the second stirring screw 62 face each other. The shield plate 140 is a plate-like member made of a nonmagnetic material, and specifically is a resin plate member that is formed from a synthetic resin that does not have magnetism. As the synthetic resin, a PET resin or the like is used. The shield plate 140 is formed in a shape elongated in the longitudinal direction of the developer case 60 (the direction vertical to the plane of FIG. 8). The shield plate 140 is fixed to the upper wall 60F that constitutes an outer wall of the developer case 60. Specifically, the shield plate 140 is fixed to an end 95 of the upper wall 60F that is provided more on the downstream side in the rotation direction (indicated by the arrow 94) of the second stirring screw 62 than the facing position where the developing roller 63 and the second stirring screw 62 face each other. More specifically, an end of the shield plate 140 in the short direction is fixed to the end 95. It is noted that various fixation methods such as adhesion, screw fastening, crimping, and welding are applicable to fix the shield plate 140.

The shield plate 140 is linearly extended from the end 95 toward the facing position where the developing roller 63 and the second stirring screw 62 face each other. An extension end 145 of the shield plate 140 in the extension direction reaches a position that is more on the upstream side in the rotation direction of the second stirring screw 62 than a vertical plane that passes through the rotation shaft 62A. The shield plate 140 is disposed in a gap between the developing roller 63 and the second stirring screw 62 so as not to abut on either of the developing roller 63 and the second stirring screw 62.

The shield plate 140 is provided with a passage 142 (an example of the guide portion of the present disclosure) for guiding the developer. The passage 142 is not provided at the facing position where the developing roller 63 and the second stirring screw 62 face each other, but is provided more on the downstream side in the rotation direction of the second stirring screw 62 than the facing position. Specifically, the passage 142 is provided in the shield plate 140 on the end 95 side. The passage 142 is a pass-through opening formed in the shield plate 140. The passage 142 is an opening that extends long and narrow in the longitudinal direction of the developer case 60. In the third embodiment, the passage 142 is located below the peeling region 89 of the developing sleeve 63A. As a result, the developer peeled from the developing roller 63 in the peeling region 89 drops downward, and passes through the passage 142 to be guided to the second stirring screw 62 in the second stirring chamber 60C. The developer is stirred again by the second stirring screw 62, and is guided to the surface of the developing roller 63.

In the third embodiment, the retaining space 99 is formed more on the upstream side in the rotation direction of the second stirring screw 62 than the facing position where the developing roller 63 and the second stirring screw 62 face each other. The retaining space 99 is formed on a developer movement route that extends from the second stirring screw 62 to the roller surface of the developing roller 63 by bypassing the extension end 145 of the shield plate 140. That is, the retaining space 99 forms a part of the developer movement route. The retaining space 99 is a space for retaining the developer that has been attracted from the second stirring screw 62 by the draw-up pole 78 and moved thereto by bypassing the extension end 145. The retaining space 99 is a space formed between the second stirring screw 62 and the regulation blade 65. The retaining space 99 is formed between the second stirring screw 62 and the regulation blade 65 by positioning the regulation blade 65 away from the second stirring screw 62 toward the downstream side in the rotation direction of the developing roller 63. With this configuration, the developer that has moved from the second stirring screw 62 into the retaining space 99 slows its movement toward the surface of the developing roller 63 and is retained in the retaining space 99. The developer, while being retained in the retaining space 99, moves slowly toward the developing roller 63. During this slow movement, the difference in draw-up amount of the developer that corresponds to the pitch of the blade member 67 is uniformed, wherein the difference in draw-up amount of the developer may be the cause of the thickness variation of the developer.

As described above, in the developing device 41 of the third embodiment, the shield plate 140 is provided at the facing position where the developing roller 63 and the second stirring screw 62 face each other. That is, the shield plate 140 is present on the route with the shortest distance from the second stirring screw 62 to the developing roller 63, namely, the route passing through the line segment connecting the rotation shaft 62A and the rotation shaft of the developing roller 63. As a result, if the developer is drawn up by the draw-up pole 78, it does not happen that the developer is supplied to the developing roller 63 by passing through the route. The developer drawn up by the draw-up pole 78 passes through the retaining space 99 and bypasses the extension end 145 of the shield plate 140 when it moves from the second stirring screw 62 to the developing roller 63. That is, the developer does not pass through the facing position where the developing roller 63 and the second stirring screw 62 face each other, but passes through the retaining space 99 to be guided to the developing roller 63, by bypassing the facing position. With this configuration, the route for the developer to reach the developing roller 63 is lengthened, and the cause of the thickness variation of the developer is solved while the developer moves in the lengthened route. As a result, it is possible to uniform the amount of developer drawn up to the developing roller 63, without giving the stress to the developer.

In addition, the shield plate 140 is provided with the passage 142 on the end 95 side. As a result, the developer peeled in the peeling region 89 passes through the passage 142 and drops to the second stirring screw 62 side. With this configuration, the peeled developer is guided to the second stirring screw 62 side, without being prohibited by the shield plate 140.

Furthermore, since the retaining space 99 is formed in the developer case 60, the developer moves in the retaining space 99 by bypassing the extension end 145 while being attracted by the magnetic force of the draw-up pole 78. The developer moves slowly in the retaining space 99. With this configuration, the amount of developer becomes uniform in the longitudinal direction of the retaining space 99, and the amount of developer drawn up to the developing roller 63 becomes uniform. In addition, since the developer retained in the retaining space 99 contacts the roller surface of the developing roller 63, the developer is easily drawn up to the roller surface of the developing roller 63.

[Modification of Third Embodiment]

Figure 10:
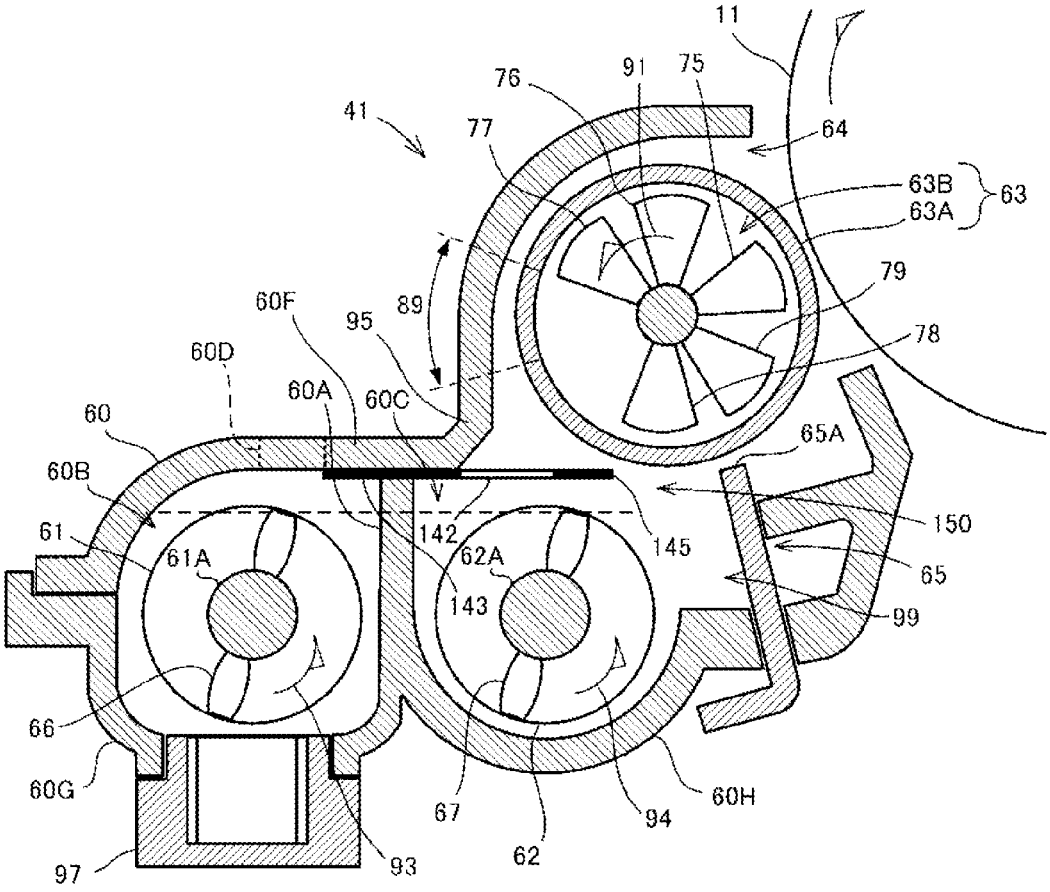
FIG. 10 is a diagram showing a modification of a shield plate in the third embodiment of the present disclosure.

The following describes, with reference to FIG. 10, a shield plate 150 that is a modification of the shield plate 140 of the third embodiment. Here, FIG. 10 is a cross section showing the configuration of the developing device 41 including the shield plate 150. It is noted that the same component elements as those described in the embodiments so far are assigned the same reference numbers, and description thereof is omitted.

The shield plate 150 shown in FIG. 10 is made of the same material as the shield plate 140 of the above-described third embodiment. That is, the shield plate 150 is composed of a resin plate member that is formed from a synthetic resin that does not have magnetism. The shield plate 150 is different from the shield plate 140 in attachment position, and otherwise is common to the shield plate 140. The shield plate 150 is fixed to an inner wall of the upper wall 60F with an fixing end 143 thereof. The shield plate 150 horizontally extends, in the second stirring chamber 60C, from the upper wall 60F to pass the end 95 and further extend toward the facing position where the developing roller 63 and the second stirring screw 62 face each other. The extension end 145 of the shield plate 150 in the extension direction reaches a position that is more on the upstream side in the rotation direction of the second stirring screw 62 than a vertical plane that passes through the rotation shaft 62A. The shield plate 150 does not to abut on either of the developing roller 63 and the second stirring screw 62, and is disposed in a gap between the developing roller 63 and the second stirring screw 62. The passage 142 is not provided at the facing position where the developing roller 63 and the second stirring screw 62 face each other, but is provided more on the downstream side in the rotation direction of the second stirring screw 62 than the facing position, below the peeling region 89.

With the shield plate 150 configured as such, it is possible to uniform the amount of developer drawn up to the developing roller 63, without giving the stress to the developer. In addition, the developer peeled in the peeling region 89 is not prohibited by the shield plate 150 from passing through the passage 142 and dropping to the second stirring screw 62.

It is noted that in the above-described third embodiment, the extension end 145 of the shield plate 140, 150 is disposed in the vicinity of the second stirring screw 62. In addition, the extension end 145 of the shield plate 140, 150 or the surface on the extension end 145 side may be in contact with the second stirring screw 62.

[Fourth Embodiment]

Next, the fourth embodiment of the present disclosure is described with reference to FIGS. 11 and 12. The fourth embodiment differs from the above-described first embodiment in that a shield sleeve 160 is applied in place of the shield plate 100. As a result, in the following description, the same component elements as those described in the first embodiment are assigned the same reference numbers, and description thereof and description of modification are omitted.

The developing device 41 includes the shield sleeve 160 (an example of the cylindrical member of the present disclosure). The shield sleeve 160 is fixed to the bottom wall 60H of the developer case 60. The shield sleeve 160 is provided to prevent the density variation in the image that is caused by the thickness variation.

Figure 11:
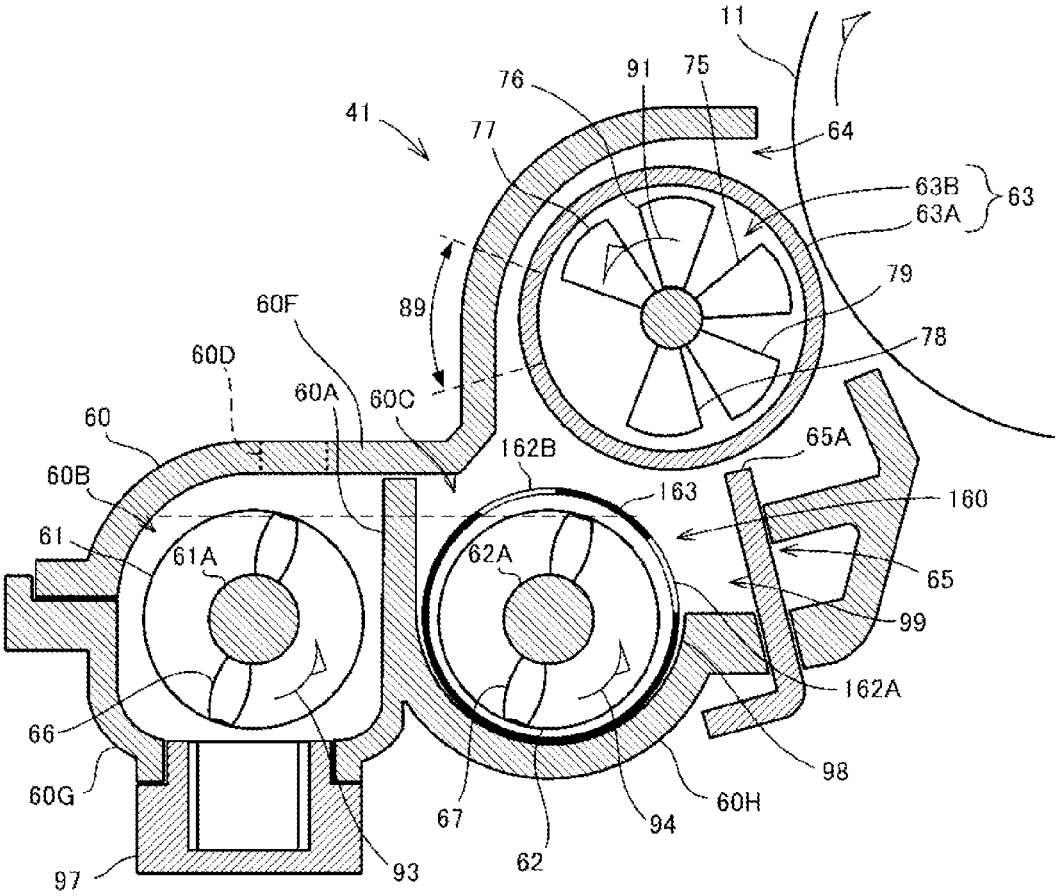
FIG. 11 is a vertical cross section showing the configuration of a developing device in the fourth embodiment of the present disclosure.
Figure 12:
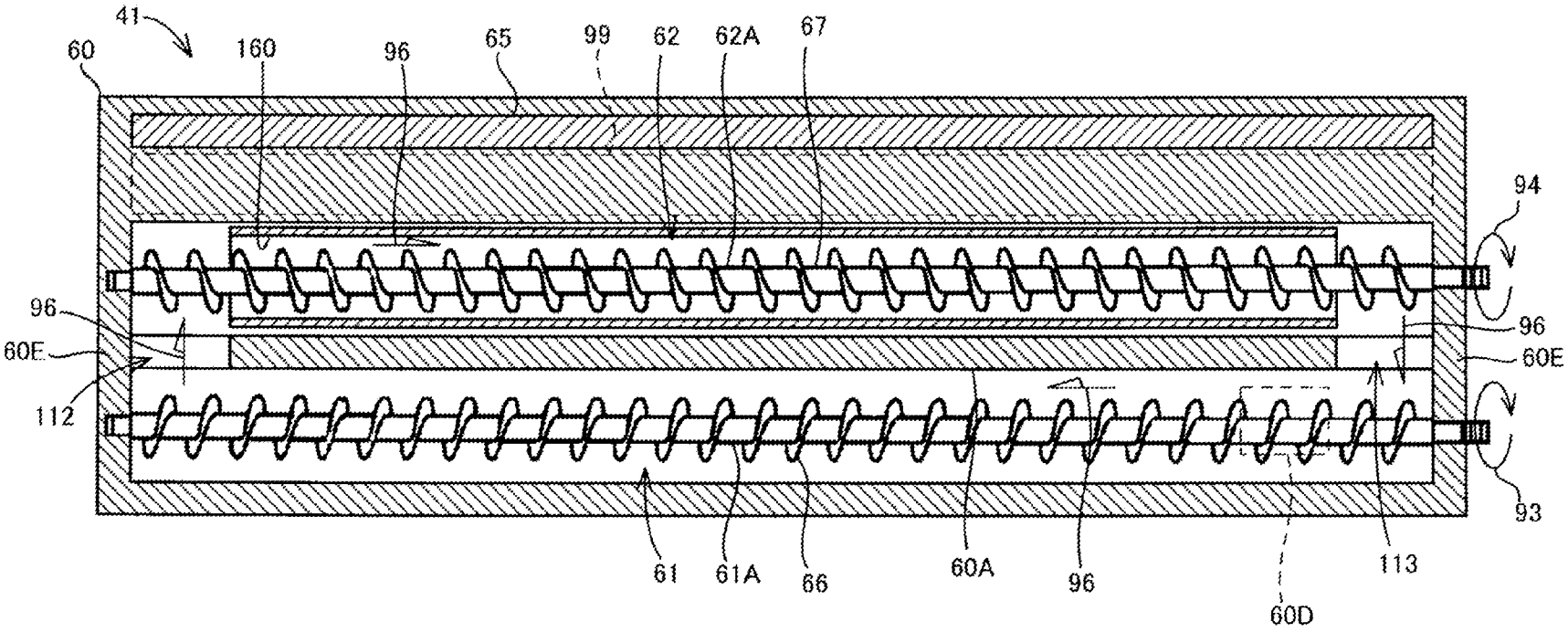
FIG. 12 is a horizontal cross section showing the configuration of the developing device in the fourth embodiment of the present disclosure.

The following describes the configuration of the shield sleeve 160 with reference to FIGS. 11 and 12.

As shown in FIGS. 11 and 12, the shield sleeve 160 is composed of a cylindrical member that is hollow inside. The shield sleeve 160 is a cylindrical member made of a nonmagnetic material, and specifically is a sleeve-like member that is formed from a synthetic resin that does not have magnetism. The shield sleeve 160 may be formed from any nonmagnetic material, not limited to a synthetic resin. The shield sleeve 160 is formed in a shape elongated in the longitudinal direction of the developer case 60 (the direction vertical to the plane of FIG. 11). The shield sleeve 160 is provided in the second stirring chamber 60C. Specifically, the shield sleeve 160 is provided in the second stirring chamber 60C to surround the outer circumferential surface of the second stirring screw 62 without contacting it. In addition, the shield sleeve 160 is provided in the second stirring chamber 60C such that it does not close the communication paths 112 and 113. Furthermore, the outer circumferential surface of the shield sleeve 160 that is on the developing roller 63 side is not in contact with the developing roller 63, and is disposed at the facing position where the developing roller 63 and the second stirring screw 62 face each other. The shield sleeve 160 is fixed to the bottom wall 60H of a circular arc shape that forms an outer wall of the developer case 60 on the bottom side. More specifically, the lower part of the shield sleeve 160 is fixed to the bottom wall 60H. It is noted that various fixation methods such as adhesion, screw fastening, crimping, and welding are applicable to fix the shield sleeve 160.

The shield sleeve 160 includes a first passage 162A (an example of the first passage of the present disclosure), a second passage 162B (an example of the second passage of the present disclosure), and a shield portion 163.

The first passage 162A is disposed in the outer circumferential wall of the shield sleeve 160 more on the upstream side in the rotation direction (indicated by the arrow 94 in FIG. 11) of the second stirring screw 62 than the facing position where the developing roller 63 and the second stirring screw 62 face each other. The first passage 162A is an opening that passes through the outer circumferential wall of the shield sleeve 160. The first passage 162A is an opening that extends long and narrow in the longitudinal direction of the developer case 60. The developer stirred by the second stirring screw 62 passes through the first passage 162A to be guided to the surface of the developing roller 63.

The second passage 162B is disposed in the outer circumferential wall of the shield sleeve 160 more on the downstream side in the rotation direction (indicated by the arrow 94 in FIG. 11) of the second stirring screw 62 than the facing position where the developing roller 63 and the second stirring screw 62 face each other. Specifically, the second passage 162B is positioned away from the first passage 162A by a predetermined interval toward the downstream side in the rotation direction of the second stirring screw 62. The second passage 162B is an opening that passes through the outer circumferential wall of the shield sleeve 160. The second passage 162B is an opening that extends long and narrow in the longitudinal direction of the developer case 60. In the present embodiment, the second passage 162B is located below the peeling region 89 of the developing sleeve 63A. As a result, the developer peeled from the developing roller 63 in the peeling region 89 drops downward, and passes through the second passage 162B to be guided to the second stirring screw 62 in the second stirring chamber 60C. The developer is stirred again by the second stirring screw 62, and is guided to the surface of the developing roller 63.

A part of the outer wall located between the first passage 162A and the second passage 162B is the shield portion 163. The shield portion 163 is disposed at the facing position where the developing roller 63 and the second stirring screw 62 face each other. The shield portion 163 is disposed to intersect with the route with the shortest distance from the second stirring screw 62 to the developing roller 63, namely, the route passing through the line segment connecting the rotation shaft 62A and the rotation shaft of the developing roller 63. With the presence of the shield portion 163, if the developer is attracted by the magnetic force of the draw-up pole 78 toward the facing position, the developer is prevented by the shield portion 163 from further moving toward the developing roller 63 side.

In the present embodiment, the retaining space 99 is formed on a route that extends from the first passage 162A of the shield sleeve 160 to the roller surface of the developing roller 63. The retaining space 99 is a space for retaining the developer that has come out of the first passage 162A. The retaining space 99 is a space formed between the second stirring screw 62 and the regulation blade 65. The retaining space 99 is formed between the second stirring screw 62 and the regulation blade 65 by positioning the regulation blade 65 away from the second stirring screw 62 toward the downstream side in the rotation direction of the developing roller 63. With this configuration, the developer that has passed through the first passage 162A by bypassing the shield portion 163 slows its movement toward the surface of the developing roller 63 and is retained in the retaining space 99. The developer, while being retained in the retaining space 99, moves slowly toward the developing roller 63. During this slow movement, the difference in draw-up amount of the developer that corresponds to the pitch of the blade member 67 is uniformed, wherein the difference in draw-up amount of the developer may be the cause of the thickness variation of the developer.

As described above, in the developing device 41 of the present embodiment, the shield sleeve 160 is provided such that the shield portion 163 is located at the facing position where the developing roller 63 and the second stirring screw 62 face each other. That is, the shield portion 163 is present on the route with the shortest distance from the second stirring screw 62 to the developing roller 63, namely, the route passing through the line segment connecting the rotation shaft 62A and the rotation shaft of the developing roller 63. As a result, if the developer is drawn up by the draw-up pole 78, it does not happen that the developer is supplied to the developing roller 63 by passing through the route. On the other hand, since the first passage 162A is formed in the shield sleeve 160, the developer attracted by the magnetic force of the draw-up pole 78 moves from the second stirring screw 62, and passes through the first passage 162A to be guided to the developing roller 63, by bypassing the shield portion 163. That is, the developer does not pass through the facing position where the developing roller 63 and the second stirring screw 62 face each other, but passes through the first passage 162A bypassing the facing position and is guided to the developing roller 63. With this configuration, the route for the developer to reach the developing roller 63 is lengthened, and the cause of the thickness variation of the developer is solved while the developer moves in the lengthened route. As a result, it is possible to uniform the amount of developer drawn up to the developing roller 63, without giving the stress to the developer.

In addition, the second passage 162B is formed in the shield sleeve 160. As a result, the developer peeled in the peeling region 89 passes through the second passage 162B and drops to the second stirring screw 62 side. With this configuration, the peeled developer is guided to the second stirring screw 62 side, without being prohibited by the shield sleeve 160.

Furthermore, since the retaining space 99 is formed in the developer case 60, it is possible to slow the movement of the developer that has entered the retaining space 99 via the first passage 162A. With this configuration, the amount of developer becomes uniform in the longitudinal direction of the retaining space 99, and the amount of developer drawn up to the developing roller 63 becomes uniform. In addition, since the developer retained in the retaining space 99 contacts the roller surface of the developing roller 63, the developer is easily drawn up to the roller surface of the developing roller 63.

[Fifth Embodiment]

Next, the fifth embodiment of the present disclosure is described with reference to FIGS. 13 through 15B. The fifth embodiment differs from the above-described first embodiment in that a shield plate 170 is applied in place of the shield plate 100 and a support portion 175 is additionally provided. As a result, in the following description, the same component elements as those described in the first embodiment are assigned the same reference numbers, and description thereof and description of modification are omitted.

Figure 15B:
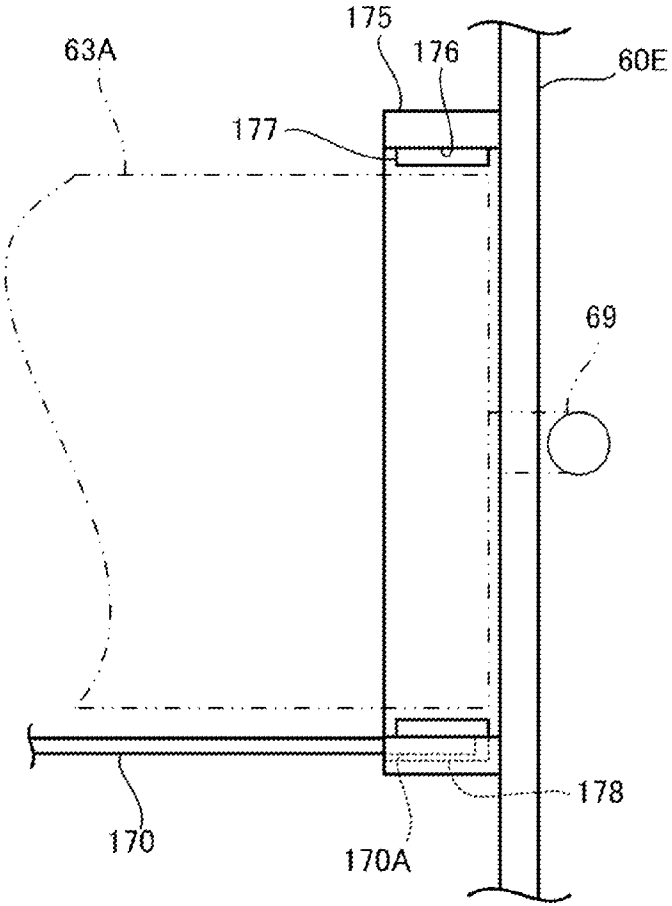
FIGS. 15A and 15B are diagrams showing the configuration of support members included in the developing device in the fifth embodiment of the present disclosure.
Figure 15A:
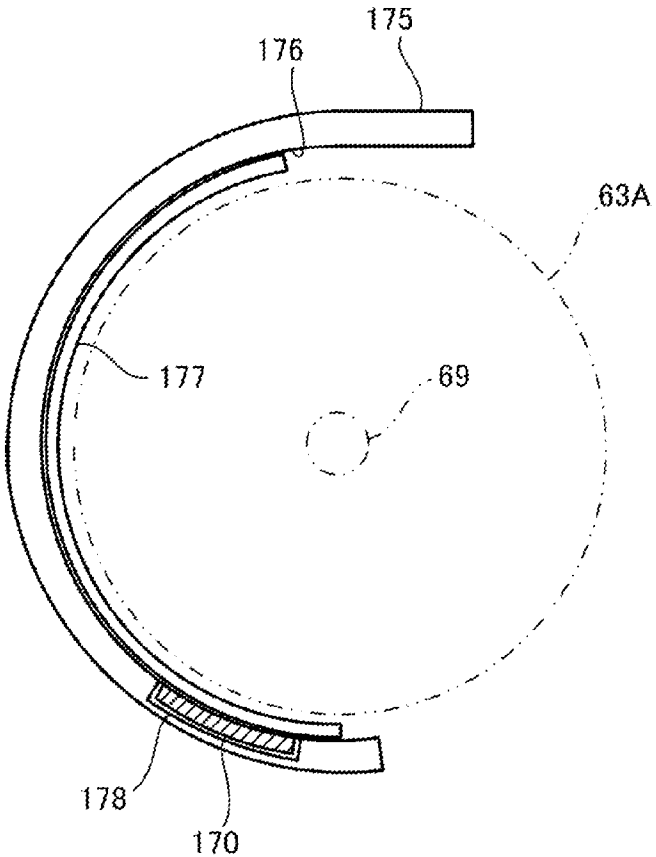

As in the above-described embodiments, the developing roller 63 includes the cylindrical developing sleeve 63A. The developing sleeve 63A is rotatably supported in the second stirring chamber 60C. In the fifth embodiment, the developing sleeve 63A is rotatably supported as shown in FIGS. 15A and 15B. Specifically, as shown in FIGS. 15A and 15B, rotation shafts 69 provided at opposite ends of the developing sleeve 63A are rotatably supported by the side walls 60E of the developer case 60, respectively. It is noted that in FIGS. 15A and 15B, a rotation shaft 69 at an end of the developing sleeve 63A and the support mechanism thereof are shown, and the support mechanism at the other end is omitted.

As shown in FIGS. 15A and 15B, support portions 175 (an example of the pair of support members of the present disclosure) of a curved shape are provided at the side walls 60E, wherein the support portions 175 cover the circumferential surfaces of the developing sleeve 63A at the opposite ends thereof in the axis direction. The support portion 175 and the side wall 60E are integrally formed. Each support portion 175 includes an arc surface 176 of a circular arc shape that faces the circumferential surface of the developing sleeve 63A at each end. The arc surface 176 of the support portion 175 is positioned away from the circumferential surface of the developing sleeve 63A by a predetermined interval. That is, there is a gap between the arc surface 176 and the circumferential surface of the developing sleeve 63A. In addition, seal members 177 are provided between the arc surface 176 and the circumferential surface of the developing sleeve 63A, wherein the seal members 177 are each made of a magnet. The seal members 177 are each a thin-sheet-like member, and are attached to the arc surface 176 by adhesion or the like. In the state where a seal member 177 is attached to the arc surface 176, there is formed a gap between the seal member 177 and the circumferential surface of the developing sleeve 63A. Since the seal members 177 made of magnets are provided on the arc surface 176, a magnetic brush composed of developer is formed between the seal member 177 and the circumferential surface of the developing sleeve 63A. This configuration prevents the developer from leaking from a gap between the arc surface 176 and the circumferential surface of the end of the developing sleeve 63A. Sponge-like members that are made of a soft material such as urethane may be applied instead of the seal members 177. The shield plate 170 is supported by the support portions 175 configured as such. It is noted that the shield plate 170 and the support mechanism thereof are described below.

The developing device 41 includes the shield plate 170 (an example of the shield plate of the present disclosure). The shield plate 170 is provided to prevent the density variation in the image that is caused by the thickness variation.

Figure 13:
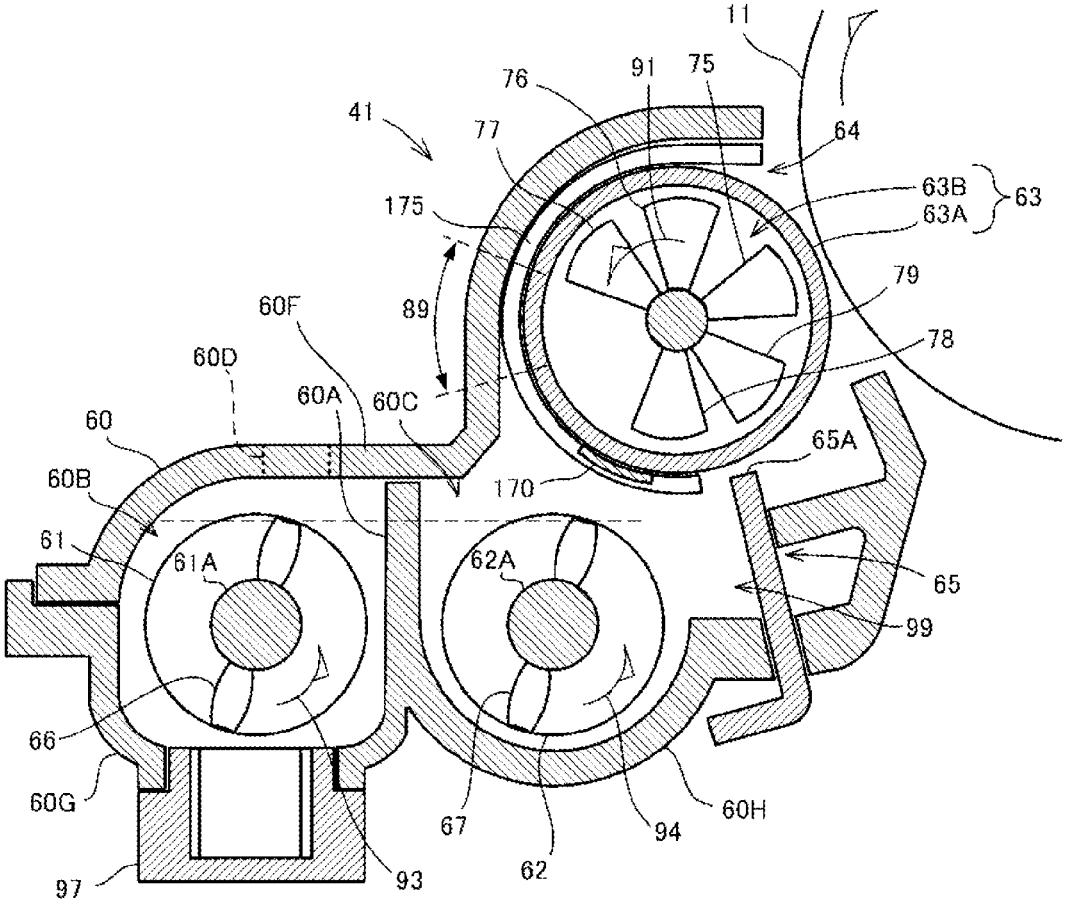
FIG. 13 is a vertical cross section showing the configuration of a developing device in the fifth embodiment of the present disclosure.
Figure 14:
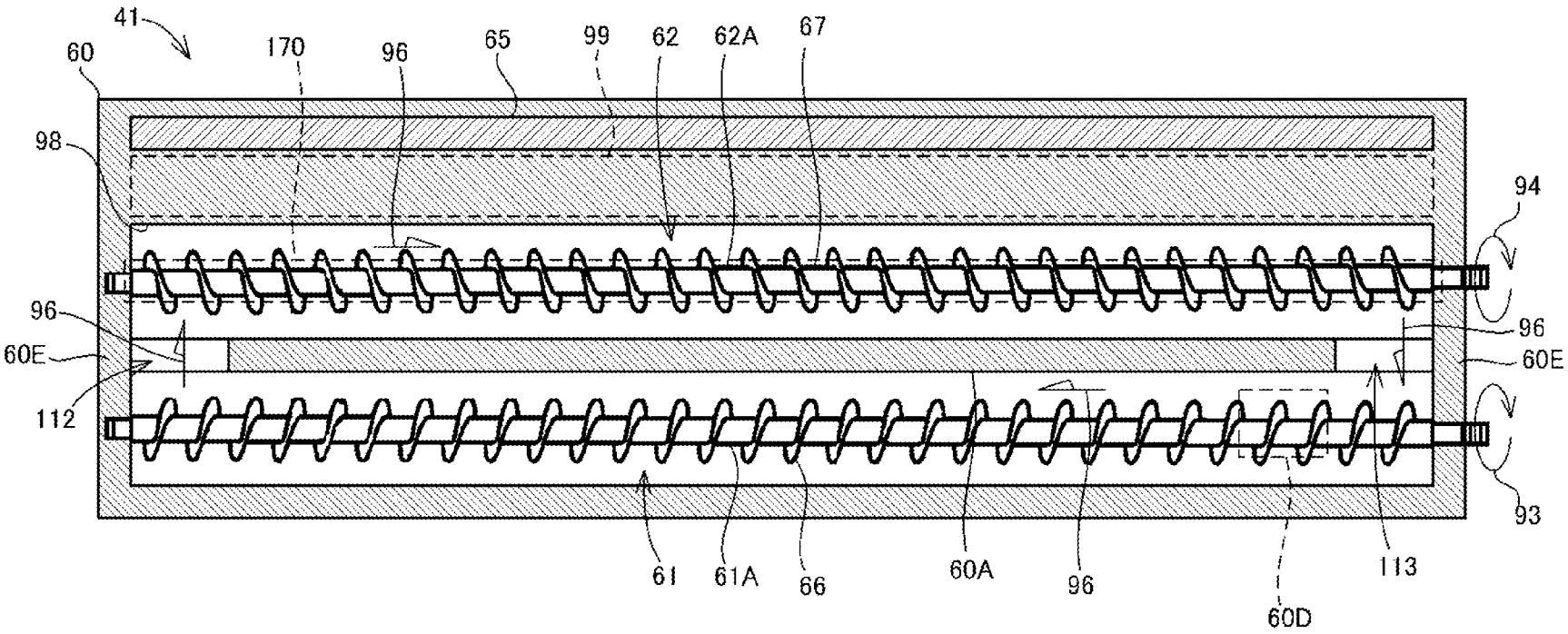
FIG. 14 is a horizontal cross section showing the configuration of the developing device in the fifth embodiment of the present disclosure.

The following describes the configuration of the shield plate 170 with reference to FIGS. 13 and 14.

As shown in FIGS. 13 and 14, the shield plate 170 is provided at the facing position where the developing roller 63 and the second stirring screw 62 face each other. The shield plate 170 is a plate-like member made of a nonmagnetic material, and specifically is a resin plate member that is formed from a synthetic resin that does not have magnetism. The shield plate 170 may be formed from any nonmagnetic material, not limited to a synthetic resin.

The shield plate 170 is elongated in the longitudinal direction of the developer case 60 (the direction vertical to the plane of FIG. 13). That is, the shield plate 170 extends in the axis direction of the developing roller 63. The shield plate 170 is formed in the shape of a circular arc in correspondence with the outer circumferential surface of the developing sleeve 63A of the developing roller 63. The length of the shield plate 170 in the short direction (the direction along the circumferential direction of the developing sleeve 63A) is of such a size as not to close the passage that extends from the peeling region 89 to the second stirring screw 62 below the peeling region 89.

FIG. 15A is a partially enlarged view of the support portion 175 viewed from the axis direction, and FIG. 15B is a partially enlarged view of the support portion 175 viewed from a direction perpendicular to the axis direction. In FIGS. 15A and 15B, the developing sleeve 63A is indicated by a two-dot chain line. As shown in FIGS. 15A and 15B, the shield plate 170 is supported by the support portions 175 that are provided at the side walls 60E of the developer case 60. Specifically, opposite ends 170A of the shield plate 170 in the longitudinal direction thereof are supported by the support portions 175, respectively. The arc surface 176 of each support portion 175 has a recessed portion 178 that is recessed from the arc surface 176 in the depth direction. The recess depth of the recessed portion 178 is set to be the same as the thickness of the end 170A of the shield plate 170. The recessed portion 178 is formed in such shape and size that enable the end 170A of the shield plate 170 to be fitted in the recessed portion 178. The ends 170A of the shield plate 170 are fitted in the recessed portions 178, respectively. This allows the shield plate 170 to be supported by the support portions 175.

In the present embodiment, the seal members 177 are attached to the arc surface 176 to cover the recessed portions 178 in the state where the ends 170A of the shield plate 170 are fitted in the recessed portions 178. With this configuration, the ends 170A of the shield plate 170 fitted in the recessed portions 178 are prevented from being slipped off, and the ends 170A are fixed to the support portions 175 in a reliable manner. It is noted that various fixation methods such as adhesion, screw fastening, crimping, and welding are applicable to fix the ends 170A to the support portions 175.

As described above, in the developing device 41 of the present embodiment, the shield plate 170 is provided at the facing position where the developing roller 63 and the second stirring screw 62 face each other. That is, the shield plate 170 is present on the route with the shortest distance from the second stirring screw 62 to the developing roller 63, namely, the route passing through the line segment connecting the rotation shaft 62A and the rotation shaft of the developing roller 63. As a result, if the developer is drawn up by the draw-up pole 78, it does not happen that the developer is supplied to the developing roller 63 by passing through the route. The developer drawn up by the magnetic force of the draw-up pole 78 moves from the second stirring screw 62 to the developing roller 63 by passing through the upstream side of the shield plate 170 in the rotation direction of the second stirring screw 62 by bypassing the shield plate 170. That is, the developer does not pass through the facing position where the developing roller 63 and the second stirring screw 62 face each other, but is guided to the developing roller 63 by bypassing the facing position. With this configuration, the route for the developer to reach the developing roller 63 is lengthened, and the cause of the thickness variation of the developer is solved while the developer moves in the lengthened route. As a result, it is possible to uniform the amount of developer drawn up to the developing roller 63, without giving the stress to the developer.

In addition, since the ends 170A of the shield plate 170 are supported by the support portions 175, there no need to provide a member other than the shield plate 170, between the developing roller 63 and the second stirring screw 62. As a result, drawing up of the developer and movement of the developer peeled in the peeling region 89 are not prohibited by an unnecessary member, but are performed smoothly.

Furthermore, since the depth of the recessed portions 178 is set to be the same as the thickness of the ends 170A of the shield plate 170, no stepped part is generated in the state where the ends 170A are fitted in the recessed portions 178. As a result, the seal members 177 attached to the arc surface 176 do not swell at the ends 170A. This prevents leakage of the developer effectively.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a storing portion storing developer which contains, as main components, a non-magnetic toner and a magnetic carrier;

a stirring member rotatably provided in the storing portion and configured to stir the developer in the storing portion by being rotationally driven in a predetermined first rotation direction;

a developing roller rotatably provided above the stirring member, and configured to be rotationally driven in a predetermined second rotation direction;

a magnet unit provided inside the developing roller and having a main pole, a carrying pole, a peeling pole, a draw-up pole, and a regulation pole that are disposed around a shaft of the developing roller, the draw-up pole being positioned so as to face the stirring member and attracting the developer in the storing portion to a surface of the developing roller by a magnetic force thereof;

a film-like, elastic shield plate made of a nonmagnetic material and provided at a facing position where the developing roller and the stirring member face each other; and a guide portion provided more on an upstream side in the first rotation direction than the facing position, and configured to guide the developer from the storing portion to the developing roller side, wherein the shield plate is extended from an end of an outer wall of the storing portion toward the facing position, the end being on a downstream side in the first rotation direction, and the guide portion is an opening formed in the shield plate.

2. The developing device according to claim 1, wherein the shield plate is extended from the end of the outer wall of the storing portion along an outer circumferential surface of the stirring member toward the facing position.

3. The developing device according to claim 1, wherein the shield plate is linearly extended from the end of the outer wall of the storing portion toward the facing position, and an extension end of the shield plate abuts on a roller surface of the developing roller.

4. The developing device according to claim 1, wherein a retaining space for retaining the developer is formed on a route that extends from the guide portion to a roller surface of the developing roller.

5. The developing device according to claim 1, wherein the shield plate is linearly extended toward the facing position from a fixing portion located on a downstream side in the second rotation direction, and abuts on an outer circumferential surface of the stirring member.

6. The developing device according to claim 5, wherein the shield plate is pressed against the outer circumferential surface of the stirring member.

7. The developing device according to claim 5, wherein the fixing portion is a regulation member provided on the downstream side in the second rotation direction and configured to regulate the developer on the developing roller in thickness.

8. An image forming apparatus comprising the developing device according to claim 1.

9. A developing device comprising:

a storing portion storing developer which contains, as main components, a non-magnetic toner and a magnetic carrier;

a stirring member rotatably provided in the storing portion and configured to stir the developer in the storing portion by being rotationally driven in a predetermined first rotation direction;

a developing roller rotatably provided above the stirring member, and configured to be rotationally driven in a predetermined second rotation direction;

a magnet unit provided inside the developing roller and having a main pole, a carrying pole, a peeling pole, a draw-up pole, and a regulation pole that are disposed around a shaft of the developing roller, the draw-up pole being positioned so as to face the stirring member and attracting the developer in the storing portion to a surface of the developing roller by a magnetic force thereof;

a film-like, elastic shield plate made of a nonmagnetic material and provided at a facing position where the developing roller and the stirring member face each other; and a guide portion provided more on a downstream side in the first rotation direction than the facing position, and configured to guide the developer peeled from the developing roller to the stirring member side in the storing portion, wherein the shield plate is extended from an outer wall of the storing portion toward the facing position, the outer wall being provided more on a downstream side in the first rotation direction than the facing position, and the guide portion is an opening formed in the shield plate.

10. The developing device according to claim 9, wherein a developer movement route is formed more on an upstream side in the first rotation direction than the facing position, the developer movement route extending from the stirring member to a roller surface of the developing roller by bypassing an extension end of the shield plate.

11. A developing device comprising:

a storing portion storing developer which contains, as main components, a non-magnetic toner and a magnetic carrier;

a stirring member rotatably provided in the storing portion and configured to stir the developer in the storing portion by being rotationally driven in a predetermined first rotation direction;

a developing roller rotatably provided above the stirring member, and configured to be rotationally driven in a predetermined second rotation direction;

a magnet unit provided inside the developing roller and having a main pole, a carrying pole, a peeling pole, a draw-up pole, and a regulation pole that are disposed around a shaft of the developing roller, the draw-up pole being positioned so as to face the stirring member and attracting the developer in the storing portion to a surface of the developing roller by a magnetic force thereof;

a cylindrical member made of a nonmagnetic material and surrounding an outer circumferential surface of the stirring member without contacting therewith;

a first passage being an opening formed in an outer circumferential wall of the cylindrical member more on an upstream side in the first rotation direction than a facing position where the developing roller and the stirring member face each other; and a second passage being an opening formed in the outer circumferential wall of the cylindrical member more on a downstream side in the first rotation direction than the facing position.

12. The developing device according to claim 11, wherein the cylindrical member is fixed to an outer wall of the storing portion.

13. The developing device according to claim 11, wherein a retaining space for retaining the developer is formed on a route that extends from the first passage to a roller surface of the developing roller.

14. A developing device comprising:

a storing portion storing developer which contains, as main components, a non-magnetic toner and a magnetic carrier;

a stirring member rotatably provided in the storing portion and configured to stir the developer in the storing portion by being rotationally driven in a predetermined first rotation direction;

a developing roller rotatably provided above the stirring member, and configured to be rotationally driven in a predetermined second rotation direction;

a magnet unit provided inside the developing roller and having a main pole, a carrying pole, a peeling pole, a draw-up pole, and a regulation pole that are disposed around a shaft of the developing roller, the draw-up pole being positioned so as to face the stirring member and attracting the developer in the storing portion to a surface of the developing roller by a magnetic force thereof;

a pair of support members respectively including arc surfaces that face circumferential surfaces of the developing roller at opposite ends of the developing roller in an axis direction of the developing roller, there being a predetermined interval between the arc surfaces and the circumferential surfaces;

a shield plate formed in a shape of a circular arc and made of a nonmagnetic material and provided at a facing position where the developing roller and the stirring member face each other, opposite ends of the shield plate being supported by the pair of support members; and seal members attached to the arc surfaces of the pair of support members so as to cover the shield plate.

15. The developing device according to claim 14, wherein the shield plate, at the facing position, extends in the axis direction of the developing roller.

16. The developing device according to claim 14, wherein the arc surfaces of the support members respectively have recessed portions, and the opposite ends of the shield plate are respectively fitted in the recessed portions such that the shield plate is supported by the support members.

* * * * *